US011735825B1

(12) United States Patent
Leung et al.

(10) Patent No.: US 11,735,825 B1
(45) Date of Patent: Aug. 22, 2023

(54) ANTENNA

(71) Applicant: City University of Hong Kong, Kowloon (HK)

(72) Inventors: Kwok Wa Leung, Kowloon (HK); Zhen-Xing Xia, Kowloon (HK); Pengfei Gu, Nanjing (CN)

(73) Assignee: City University of Hong Kong, Kowloon (HK)

( * ) Notice: Subject to any disclaimer, the term of this patent is extended or adjusted under 35 U.S.C. 154(b) by 0 days.

(21) Appl. No.: 17/836,123

(22) Filed: Jun. 9, 2022

(51) Int. Cl.

| | |
|---|---|
| ***H01Q 15/08*** | (2006.01) |
| ***H01Q 9/04*** | (2006.01) |
| ***H01Q 1/32*** | (2006.01) |
| ***H01Q 5/30*** | (2015.01) |
| ***H01Q 15/14*** | (2006.01) |

(52) U.S. Cl.
CPC ..... *H01Q 15/08* (2013.01); *H01Q 1/32* (2013.01); *H01Q 5/30* (2015.01); *H01Q 9/0485* (2013.01); *H01Q 15/144* (2013.01)

(58) Field of Classification Search
CPC ..... H01Q 15/08; H01Q 1/32; H01Q 5/30; H01Q 9/0485; H01Q 15/144
See application file for complete search history.

(56) References Cited

U.S. PATENT DOCUMENTS

| | | | | |
|---|---|---|---|---|
| 8,174,454 | B2 | 5/2012 | Mayer | |
| 8,446,884 | B2 | 5/2013 | Petite | |
| 8,497,810 | B2 | 7/2013 | Kits van | |
| 8,773,319 | B1 * | 7/2014 | Anderson | H01Q 13/06 343/705 |
| 8,816,935 | B2 | 8/2014 | Liu et al. | |
| 9,160,079 | B2 | 10/2015 | Carr | |
| 9,515,388 | B2 * | 12/2016 | Chernokalov | H01Q 19/062 |
| 9,673,526 | B1 | 6/2017 | Jensen | |
| 9,766,330 | B2 * | 9/2017 | Nagaishi | H01Q 1/42 |
| 10,361,729 | B2 | 7/2019 | Chiang | |
| 10,879,616 | B2 | 12/2020 | Cheng | |
| 10,923,818 | B2 | 2/2021 | Leung et al. | |
| 10,992,052 | B2 * | 4/2021 | Kratzenberg | H01Q 13/02 |
| 11,108,143 | B2 | 8/2021 | Leung et al. | |
| 2019/0221939 | A1 * | 7/2019 | George | H01Q 19/18 |
| 2020/0083602 | A1 * | 3/2020 | Sethumadhavan | H01Q 21/205 |

OTHER PUBLICATIONS

L. Liang, H. Peng, G. Y. Li and X. Shen, "Vehicular communications: A physical layer perspective", IEEE Trans. Veh. Technol., vol. 66, No. 12, pp. 10 647-10 659, Dec. 2017.

L. Ge, S. Gao, Y. Li, W. Qin and J. Wang, "A low-profile dual-band antenna with different polarization and radiation properties over two bands for vehicular communications", IEEE Trans. Veh. Technol., vol. 68, No. 1, pp. 1004-1008, Jan. 2019.

(Continued)

*Primary Examiner* — Vibol Tan
(74) *Attorney, Agent, or Firm* — Renner Kenner Greive Bobak Taylor & Weber

(57) ABSTRACT

An antenna that comprises a dielectric body and a feed arrangement. The dielectric body includes a first portion operable as a dielectric lens and a second portion operable as a dielectric resonator. The feed arrangement is operably coupled with the dielectric body for operating the antenna as a dielectric lens antenna and a dielectric resonator antenna.

35 Claims, 31 Drawing Sheets

(56) References Cited

OTHER PUBLICATIONS

S. Wang, L. Zhu, G. Zhang, J. Yang, J. Wang and W. Wu, "Dual-band dual-CP all-metal antenna with large signal coverage and high isolation over two bands for vehicular communications", IEEE Trans. Veh. Technol., vol. 69, No. 1, pp. 1131-1135, Jan. 2020.
S. Chen, Y. Chen, S. Zhang and N. Zheng, "A novel integrated simulation and testing platform for self-driving cars with hardware in the loop", IEEE Trans. Intell. Veh., vol. 4, No. 3, pp. 425-436, Sep. 2019.
K. L. Lim et al., "Evolution of a reliable and extensible high-level control system for an autonomous car", IEEE Trans. Intell. Veh., vol. 4, No. 3, pp. 396-405, Sep. 2019.
B. Feng, J. Chen, S. Yin, C.-Y.-D. Sim and Z. Zhao, "A tri-polarized antenna with diverse radiation characteristics for 5G and V2X communications", IEEE Trans. Veh. Technol., vol. 69, No. 9, pp. 10115-10126, Sep. 2020.
J. Zhu, Y. Yang, S. Li, S. Liao and Q. Xue, "Dual-band dual circularly polarized antenna array using FSS-integrated polarization rotation AMC ground for vehicle satellite communications", IEEE Trans. Veh. Technol., vol. 68, No. 11, pp. 10 742-10 751, Nov. 2019.
C. Mao, S. Gao and Y. Wang, "Dual-band full-duplex TX/RX antennas for vehicular communications", IEEE Trans. Veh. Technol., vol. 67, No. 5, pp. 4059-4070, May 2018.
H. Wong, K. K. So and X. Gao, "Bandwidth enhancement of a monopolar patch antenna with V-shaped slot for car-to-car and WLAN communications", IEEE Trans. Veh. Technol., vol. 65, No. 3, pp. 1130-1136, Mar. 2016.
S.-Y. Lien et al., "3GPP NR sidelink transmissions toward 5G v2X", IEEE Access, vol. 8, pp. 35 368-35 382, 2020.
R. Lu, L. Zhang, J. Ni and Y. Fang, "5G vehicle-to-everything services: Gearing up for security and privacy", Proc. IEEE, vol. 108, No. 2, pp. 373-389, Feb. 2020.
Z.-X. Xia, K. W. Leung, M. W. K. Lee and N. Yang, "Miniature dual-band meander-line monopole chip antenna with Independent band control", IEEE Antennas Wireless Propag. Lett., vol. 18, No. 9, pp. 1873-1877, Sep. 2019.
K. Wong, H. Chang, C. Wang and S. Wang, "Very-low-profile grounded coplanar waveguide-fed dual-band WLAN slot antenna for on-body antenna application", IEEE Antennas Wireless Propag. Lett., vol. 19, No. 1, pp. 213-217, Jan. 2020.
X. Jafargholi, A. Jafargholi and B. Ghalamkari, "Dual-band slim microstrip patch antennas", IEEE Trans. Antennas Propag., vol. 66, No. 12, pp. 6818-6825, Dec. 2018.
T. Li and Z. N. Chen, "Metasurface-based shared-aperture 5G S/Kband antenna using characteristic mode analysis", IEEE Trans. Antennas Propag., vol. 66, No. 12, pp. 6742-6750, Dec. 2018.
Z.-X. Xia, K. W. Leung, N. Yang and K. Lu, "Compact dual-frequency antenna array with large frequency ratio", IEEE Trans. Antennas Propag., vol. 69, No. 4, pp. 2031-2040, Apr. 2021.
T. Zhihong, Y. P. Zhang, C. Luxey, A. Bisognin, D. Titz and F. Ferrero, "A ceramic antenna for tri-band radio devices", IEEE Trans. Antennas Propag., vol. 61, No. 11, pp. 5776-5780, Nov. 2013.
Y. R. Ding and Y. J. Cheng, "Ku/Ka dual-band dual-polarized sharedaperture beam-scanning antenna array with high isolation", IEEE Trans. Antennas Propag., vol. 67, No. 4, pp. 2413-2422, Apr. 2019.
K. M. Luk and K. W. Leung, Dielectric Resonator Antenna, Hertfordshire England, U. K.:Research Studies Press, 2003.
A. Petosa, Dielectric Resonator Antenna Handbook. Norwood: Artech House Publishers, 2007.
S. A. Long, M. W. McAllister and L. C. Shen, "The resonant cylindrical dielectric cavity antenna", IEEE Trans. Antennas Propag., vol. 31, No. 3, pp. 406-412, May 1983.
R. K. Mongia and A. Ittipiboon, "Theoretical and experimental investigations on rectangular dielectric resonator antennas", IEEE Trans. Antennas Propag., vol. 45, No. 9, pp. 1348-1356, Sep. 1997.
M. S. A. Salameh, Y. M. M. Antar and G. Seguin, "Coplanar-waveguide-fed slot-coupled rectangular dielectric resonator antenna", IEEE Trans. Antennas Propag., vol. 50, No. 10, pp. 1415-1419, Oct. 2002.
I. A. Eshrah, A. A. Kishk, A. B. Yakovlev and A. W. Glisson, "Theory and implementation of dielectric resonator antenna excited by a waveguide slot", IEEE Trans. Antennas Propag., vol. 53, No. 1, pp. 483-494, Jan. 2005.
X. S. Fang and S. M. Chen, "Design of the wide dual-band rectangular souvenir dielectric resonator antenna", IEEE Access, vol. 7, p. 161 621-161 629, 2019.
P. Kumar et al., "Electronically controlled beam steerable dual-band star-shaped DRA for UAS and Wi-Fi data link applications", IEEE Trans Antennas Propag., vol. 68, No. 10, pp. 7214-7218, Oct. 2020.
Y. X. Sun and K. W. Leung, "Dual-band and wideband dual-polarized cylindrical dielectric resonator antennas", IEEE Antennas Wireless Propag. Lett., vol. 12, pp. 384-387, 2013.
H. Tang, J. Chen, W. Yang, L. Zhou and W. Li, "Differential dual-band dual-polarized dielectric resonator antenna", IEEE Trans. Antennas Propag., vol. 65, No. 2, pp. 855-860, Feb. 2017.
X. Wang, L. Sun, X. Lu, S. Liang and W. Lu, "Single-feed dual-band circularly polarized dielectric resonator antenna for DNSS applications", IEEE Trans. Antennas Propag , vol. 65, No. 8, pp. 4283-4287, Aug. 2017.
Y. Zhou, Y. Jiao, Z. Weng and T. Ni, "A novel single-fed wide dual-band circularly polarized dielectric resonator antenna", IEEE Antennas Wireless Propag. Lett., vol. 15, pp. 930-933, 2016.
M. Zhang, B. Li and X. Lv, "Cross-slot-coupled wide dual-band circularly polarized rectangular dielectric resonator antenna", IEEE Antennas Wireless Propag. Lett., vol. 13, pp. 532-535, 2014.
Y. Sun and K. W. Leung, "Substrate-integrated two-port dual-frequency antenna", IEEE Trans. Antennas Propag., vol. 34, No. 8, pp. 3692-3697, Aug. 2016.
L. Y. Feng and K. W. Leung, "Wideband dual-frequency antenna with large frequency ratio", IEEE Trans. Antennas Propag., vol. 67, No. 3, pp. 1981-1986, Mar. 2019.
A. I. Dimitriadis et al., "Polymer-based additive manufacturing of high-performance waveguide and antenna components". Proc. IEEE, vol. 105, No. 4, pp. 668-676, Apr. 2017.
F. Calignano et al., "Overview on additive manufacturing technologies", Proc. IEEE, vol. 105, No. 4, pp. 593-612, Apr. 2017.
H. Xin and M. Liang, "3-D-printed microwave and THz devices using polymer jetting techniques", Proc. IEEE, vol. 105, No. 4, pp. 737-755, Apr. 2017.
B. Zhang, Y. Guo, H. Zirath and Y. P. Zhang, "Investigation on 3-D printing technologies for millimeter-wave and terahertz applications", Proc. IEEE, vol. 105, No. 4, pp. 723-736, Apr. 2017.
J.-P. Kruth, M. C. Leu and T. Nakagawa, "Progress in additive manufacturing and rapid prototyping", CIRP Ann. Manuf. Technol., vol. 47, No. 2, pp. 525-540, 1998.
S. Alkaraki et al., "Compact and low-cost 3-D printed antennas metalized using spray-coating technology for 5G mm-wave communication systems", IEEE Antennas Wireless Propag. Lett., vol. 17, No. 11, pp. 2051-2055, Nov. 2018.
G. Addamo et al., "3-D printing of high-performance feed horns from Ku- to V-bands", IEEE Antennas Wireless Propag. Lett., vol. 17, No. 11, pp. 2036-2040, Nov. 2018.
M. Liang, C. Shemelya, E. MacDonald, R. Wicker and H. Xin, "3-D-printed microwave patch antenna via fused deposition method and ultrasonic wire mesh embedding technique", IEEE Antennas Wireless Propag. Lett., vol. 14, pp. 1346-1349, 2015.
Y. Li, L. Ge, M. Chen, Z. Zhang, Z. Li and J. Wang, "Multibeam 3-D-printed luneburg lens fed by magneto-electric dipole antennas for millimeter-wave MIMO applications", IEEE Trans. Antennas Propag., vol. 67, No. 5, pp. 2923-2933, May 2019.
P. Nayeri et al., "3D printed dielectric reflectarrays: Low-cost high-gain antennas at sub-millimeter waves", IEEE Trans. Antennas Propag., vol. 62, No. 4, pp. 2000-2008, Apr. 2014.
J. Huang, S. J. Chen, Z. Xue, W. Withayachumnankul and C. Furneaux, "Impact of infill pattern on 3D printed dielectric resonator antennas". Proc. IEEE Asia-Pacific Conf. Antennas Propag ., pp. 233-235, 2018.

(56) References Cited

OTHER PUBLICATIONS

Z.-X. Xia, K. W. Leung and K. Lu, "3-D-printed wideband multi-ring dielectric resonator antenna", IEEE Antennas Wireless Propag. Lett., vol. 18, No. 10, pp. 2110-2114, Oct. 2019.
J. Thornton and K. C. Huang, Modern Lens Antennas for Communications Engineering, Hoboken, NJ, USA:Wiley, 2013.
X. Chen, T. M. Grzegorczyk, B.-I. Wu, J. Pacheco and J. A. Kong, "Robust method to retrieve the constitutive effective parameters of metamaterials", Phys. Rev. E, vol. 70, No. 1, 2004.
D. R. Smith, D. C. Vier, T. Koschny and C. M. Soukoulis, "Electromagnetic parameter retrieval from inhomogeneous metamaterials", Phys. Rev. E, vol. 71, No. 3, 2005.
L. Y. Feng and K. W. Leung, "Dual-fed hollow dielectric antenna for dual-frequency operation with large frequency ratio", IEEE Trans. Antennas Propag., vol. 65, No. 6, pp. 3308-3313, Jun. 2017.
Xia, Z-X., Leung, K. W., Gu, P., & Chen, R. (2022). 3-D-Printed Wideband High-Efficiency Dual-Frequency Antenna for Vehicular Communications IEEE Transactions on Vehicular Technology, 71(4), 3457-3469.

* cited by examiner

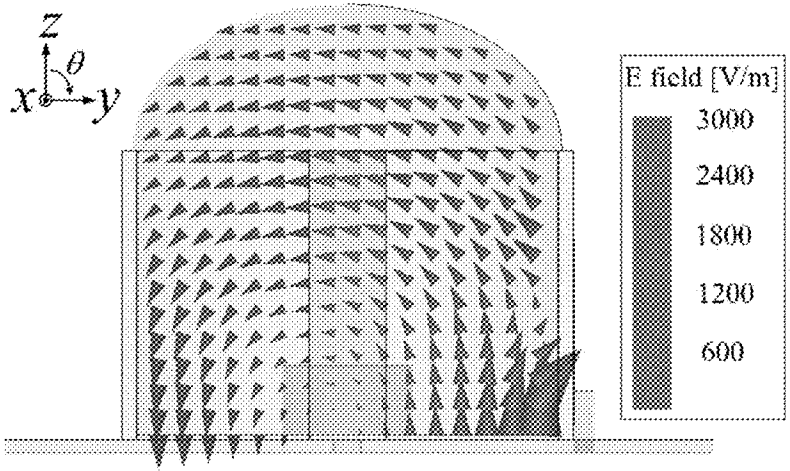
Figure 8A
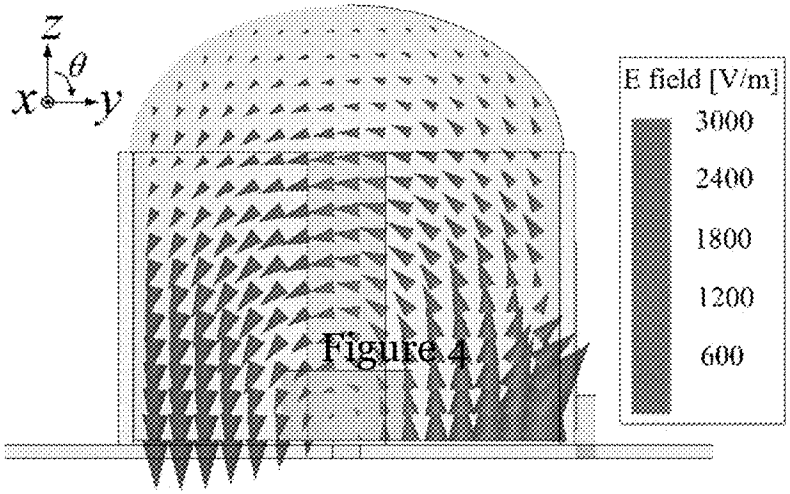
Figure 8B
Figure 4

ANTENNA

TECHNICAL FIELD

The invention relates to an antenna, such as but not limited to a multi-frequency-band antenna suitable for vehicular communication.

BACKGROUND

Antennas are commonly used in wireless communication systems for facilitating communication of information and/or data via electromagnetic (radio) waves. In one example, antennas can be used in autonomous vehicles to enable or facilitate vehicular communication.

SUMMARY OF THE INVENTION

In a first aspect, there is provided an antenna. The antenna comprises a (single) dielectric body having a first portion operable as a dielectric lens and a second portion operable as a dielectric resonator. The antenna also comprises a feed arrangement operably coupled with the dielectric body, for operating the antenna as a dielectric lens antenna and a dielectric resonator antenna. The antenna may be a multi-band antenna that is operable at multiple (two or more) frequency bands. In some embodiments, the antenna is a dual-band antenna. In some embodiments, the antenna operates as a receiver antenna. In some embodiments, the antenna operates as a transmitter antenna. In some embodiments, the antenna operates as a transceiver antenna.

In some embodiments, the antenna is operable as the dielectric lens antenna and the dielectric resonator antenna simultaneously. In some embodiments, the antenna is operable as the dielectric lens antenna and the dielectric resonator antenna selectively (i.e., one at a time).

The dielectric body may consist of the first and second portions. Alternatively, the dielectric body may comprise one or more further portions. For example, the dielectric body may further comprise one or more portions each operable as a dielectric lens and/or one or more portions each operable as a dielectric resonator.

Optionally, the first portion is also operable as a dielectric resonator, e.g., when the antenna operates as the dielectric resonator antenna.

Optionally, the antenna is arranged to operate as the dielectric lens antenna at a first frequency; and the antenna is arranged to operate as the dielectric resonator antenna at a second frequency different from the first frequency. Optionally, the first frequency is higher than the second frequency. Optionally, the first frequency is a frequency in X-band. Optionally, the second frequency is a frequency in S-band.

Optionally, the antenna is arranged to operate as the dielectric lens antenna at a first frequency band; and the antenna is arranged to operate as the dielectric resonator antenna at a second frequency band different from the first frequency band.

Optionally, the antenna is arranged to operate as the dielectric resonator antenna in at least $HEM_{11\delta}$ mode.

Optionally, the first frequency band is spaced apart from the second frequency band.

Optionally, the first frequency band is higher than the second frequency band.

Optionally, the first frequency band comprises or consists of X-band. The X-band may cover at least 10 GHz to 10.5 GHz. The X-band is suitable for, among other applications, vehicle-to-satellite communications (e.g., when the antenna is mounted or attached to a vehicle).

Optionally, the second frequency band comprises or consists of S-band. The S-band may cover at least 3.3 GHz to 3.6 GHz. The S-band is suitable for, among other applications, vehicle-to-everything (V2X) communication, e.g., 5G V2X communication (e.g., when the antenna is mounted or attached to a vehicle).

Optionally, the first portion has a first dielectric constant, and the second portion has a second dielectric constant different from the first dielectric constant. Optionally, the second dielectric constant is larger than the first dielectric constant. For example, the second dielectric constant is at least two times the first dielectric constant.

Optionally, the first portion has a first effective dielectric constant, and the second portion has a second effective dielectric constant different from the first effective dielectric constant. Optionally, the second effective dielectric constant is larger than the first effective dielectric constant. For example, the second effective dielectric constant is at least two times the first effective dielectric constant. The material(s) that form the first portion and the material(s) that form the second portion may have the same dielectric constant, and the difference in the effective dielectric constants may be achieved by structural modifications.

Optionally, the first portion defines, at least, a convex boundary surface. Optionally, the first portion defines, at least, a concave boundary surface.

Optionally, the first portion defines, at least, a generally dome shaped boundary surface. Optionally, the generally dome shaped boundary surface comprises or consists of a truncated-ellipsoidal boundary surface, such as a hemi-ellipsoidal boundary surface. The first portion may further define a planar boundary surface.

Optionally, the first portion comprises or consists of a waffle structure. The waffle structure may be a waffle-like ribbed structure. Optionally, the waffle structure comprises a first array of ribs and a second array of ribs intersecting with the first array of ribs in a decussate manner. The first array of ribs may be generally parallel with each other. The second array of ribs may be generally parallel with each other. The first array of ribs may be generally perpendicular to the second array of ribs. Optionally, thickness of the ribs in the first array are substantially the same. Optionally, thickness of the ribs in the second array are substantially the same. Optionally, thickness of the ribs in the first and second arrays are substantially the same.

Optionally, the second portion defines, at least, a generally cylindrical boundary surface. The second portion may further define an axial end planar boundary surface. The axial end planar boundary surface may contact the planar boundary surface of the first portion.

Optionally, the second portion comprises or consists of a waffle structure. The waffle structure may be a waffle-like ribbed structure. Optionally, the waffle structure comprises a first array of ribs and a second array of ribs intersecting with the first array of ribs in a decussate manner. The first array of ribs may be generally parallel with each other. The second array of ribs may be generally parallel with each other. The first array of ribs may be generally perpendicular to the second array of ribs. Optionally, thickness of the ribs in the first array are substantially the same. Optionally, thickness of the ribs in the second array are substantially the same. Optionally, thickness of the ribs in the first and second arrays are substantially the same. Optionally, thickness of the ribs in the first and second arrays of the second portion is larger than thickness of the ribs in the first and second arrays of the first array.

Optionally, the ribs in the first and second arrays of the second portion generally align with the ribs in the first and second arrays of the first portion.

Optionally, the first portion defines a first height, and the second portion defines a second height larger than the first height.

Optionally, the first portion defines a first maximum height, the second portion defines a second maximum height larger than the first maximum height.

Optionally, the first portion comprises a first air-filling ratio and the second portion comprises a second air-filling ratio less than the first air-filling ratio.

Optionally, the first portion is arranged above, or directly above, the second portion, with respect to the feed arrangement.

Optionally, the feed arrangement comprises: a first feed mechanism operably coupled with the dielectric body, for operating the antenna as the dielectric lens antenna; and a second feed mechanism operably coupled with the dielectric body, for operating the antenna as the dielectric resonator antenna.

Optionally, the first feed mechanism comprises a feed antenna. Optionally, the feed antenna comprises a slot-coupled dielectric resonator antenna. The slot-coupled dielectric resonator antenna may include, at least, a dielectric resonator element, a coupling slot arranged in a ground plane on one side of a substrate, and a feedline arranged on another side of the substrate and operably coupled with the coupling slot. Optionally, the coupling slot is a generally rectangular slot. The feedline may be connected with a feed port (RF connector). Optionally, the feedline elongates along a first axis and the coupling slot elongates in a second axis generally perpendicular to the first axis. The first and second axes may be horizontal axes. Optionally, the feedline and the coupling slot cross in plan view. Optionally, the dielectric resonator element overlaps with the crossing of the feedline and the coupling slot in plan view. Optionally, the dielectric resonator element is received by or substantially enclosed by the dielectric body, or received by or substantially enclosed by the second portion of the dielectric body. Optionally, the dielectric resonator element comprises or consists of a solid body. The solid body may be cylindrical.

Optionally, the dielectric resonator element has a third dielectric constant larger than the second dielectric constant. For example, the third dielectric constant is at least two times the second dielectric constant.

Optionally, the dielectric resonator element has a third effective dielectric constant larger than the second effective dielectric constant. For example, the third effective dielectric constant is at least two times the second effective dielectric constant. The material(s) that form the dielectric resonator element and the material(s) that form the first/second portion may have the same dielectric constant, and the difference in the effective dielectric constants may be achieved by structural modifications.

Optionally, the first feed mechanism comprises a plurality of said feed antennas for facilitating or enabling beamsteering.

Optionally, the second feed mechanism comprises: a feed strip attached to the dielectric body or the second portion, a feedline arranged on one side of the substrate, and an electrical conductor electrically connecting the feed strip and the feedline. The electrical conductor is arranged to operate as a signal probe, a feed probe, etc. The feedline may be connected with a feed port (RF connector). Optionally, the feed strip is attached to the dielectric body with adhesives. Optionally, the feedline elongates along a first axis and the feed strip elongates along a second axis generally perpendicular to the first axis. The first axis may be a horizontal axis and the second axis may be a vertical axis. Optionally, the electrical conductor extends generally perpendicular to the substrate. Optionally, the electrical conductor extends through the substrate.

Optionally, the antenna further comprises a substrate with a ground plane, and the dielectric body is mounted on the ground plane, and the feed arrangement is arranged at least partly on the substrate.

Optionally, the substrate is a PCB substrate. The substrate may be a two-sided substrate (with electrical conductors on both sides). For example, the substrate may include a ground plane on one side and feed line(s) on another side.

Optionally, the first portion is additively manufactured. Optionally, the second portion is additively manufactured. Optionally, the dielectric body is additively manufactured. Optionally, the dielectric resonator element is additively manufactured. The additive manufacturing may be performed by 3D printing, e.g., using fused deposition modeling (FDM), electron beam melting, binder jetting, polymer jetting, selective laser melting, ceramic stereolithography, micro-stereolithography, etc.

Optionally, the dielectric body and the dielectric resonator element are integrally formed.

In a second aspect, there is provided a vehicle comprising one or more of the antennas of the first aspect. The vehicle may be any of: a unicycle, a bicycle, a tricycle, a wagon, a trolley, a cart, a motorcycle, a car, a truck, a bus, a train, a tram, a ship, a boat, a yacht, a hovercraft, an airplane, a helicopter, a spacecraft, a rocket, etc. The vehicle may be an autonomous vehicle or a semi-autonomous vehicle. The one or more antennas may be used for communicating data and/or information with base station(s), satellite(s), intelligent infrastructure(s), intelligent transportation system(s), other vehicle(s), etc. The data and/or information may be related to vehicle location, position, status, operation, etc., or multimedia, etc.

In a third aspect, there is provided a communication device comprising one or more of the antennas of the first aspect. The communication device may be a mobile or portable device.

In a fourth aspect, there is provided a communication system comprising one or more of the antennas of the first aspect. The communication system may be a vehicular communication system, a satellite communication system, etc.

In a fifth aspect, there is provided an antenna array comprising one or more of the antennas of the first aspect. For example, the antenna array may include at least one antenna of the first aspect, and optionally, one or more other antennas.

In a sixth aspect, there is provided a method of making the antenna of the first aspect. The method includes forming a dielectric body having a first portion operable as a dielectric lens and a second portion operable as a dielectric resonator. The method also includes connecting the dielectric body with a feed arrangement such that the feed arrangement is operably coupled with the dielectric body for operating the antenna as a dielectric lens antenna and a dielectric resonator antenna.

Optionally, the forming comprises integrally forming the dielectric body. Optionally, the forming is performed by additive manufacturing, e.g., 3D printing. The additive manufacturing may be based on any of: fused deposition modeling (FDM), electron beam melting, binder jetting, polymer jetting, selective laser melting, ceramic stereolithography, micro-stereolithography, etc.

Terms of degree such that "generally", "about", "substantially", or the like, are, depending on context, used to take into account at least one of: manufacture tolerance, degradation, trend, tendency, etc.

Unless otherwise specified, the terms "connected", "coupled", "mounted" or the like, may encompass both direct and indirect connection, coupling, mounting, etc.

Other features and aspects of the invention will become apparent by consideration of the detailed description and accompanying drawings. Any feature(s) described herein in relation to one aspect or embodiment may be combined with any other feature(s) described herein in relation to any other aspect or embodiment, as appropriate and applicable.

BRIEF DESCRIPTION OF THE DRAWINGS

Embodiments of the invention will now be described, by way of example, with reference to the accompanying drawings in which:

FIG. 8A is a vector plot of simulated electric field distribution in the solid dielectric resonator antenna at a resonant frequency of 3.12 GHz;

FIG. 8B is a vector plot of simulated electric field distribution in the solid dielectric resonator antenna at a resonant frequency of 3.94 GHz;

DETAILED DESCRIPTION

Figure 1:
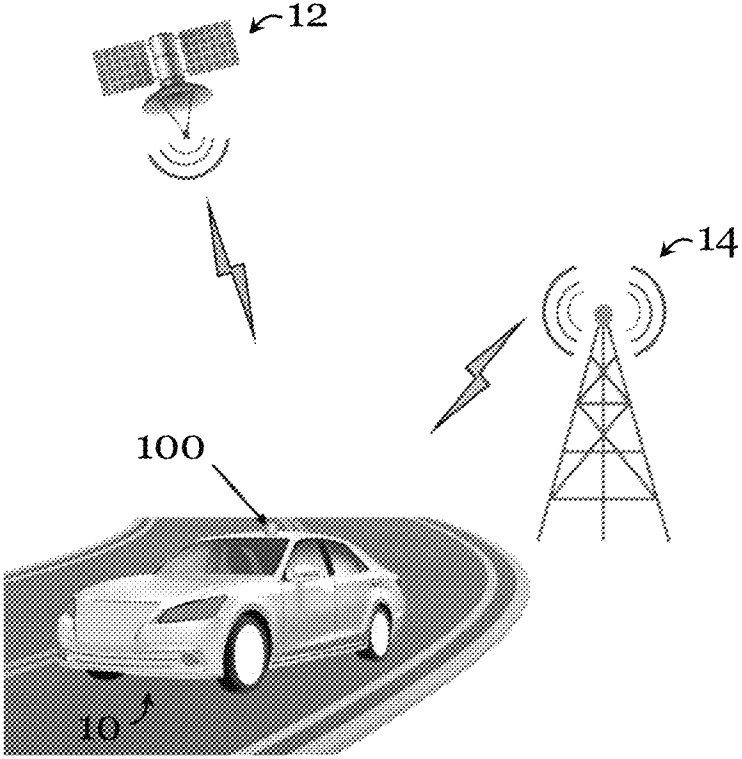
FIG. 1 is a schematic diagram illustrating a car mounted with an antenna in one embodiment of the invention.

FIG. 1 illustrates an operation environment including an autonomous vehicle 10, a satellite 12, and a base station 14. The autonomous vehicle 10 includes a control system with sensors and processors, and an antenna 100 operably connected with or in the control system. In this example, the antenna 100 is mounted on the roof of the vehicle 10 and is arranged to enable communication between the vehicle 10 and one or more external devices or systems (such as the satellite 12, the base station 14, other vehicle(s)). In this example, the antenna 100 is arranged to communicate with the satellite 12 using a higher frequency band and to communicate with the base station 14 using a lower frequency band. The antenna may communication using vehicle-to-everything (V2X) communication protocol(s), such as cellular (e.g., 4G, 5G, or above) V2X communication protocols. The antenna 100 may communicate with the satellite 12 and the base station 14 simultaneously during operation of the vehicle 10, e.g., to obtain location/position information and to receive multimedia data (e.g., music, movie). The antenna 100 is preferably, although not necessarily, a compact wideband high-efficiency dual-frequency-band antenna, as a wideband antenna can increase the capacity of wireless communication system and a high-efficiency antenna can reduce the overall system loss and improve energy efficiency.

Figure 2B:
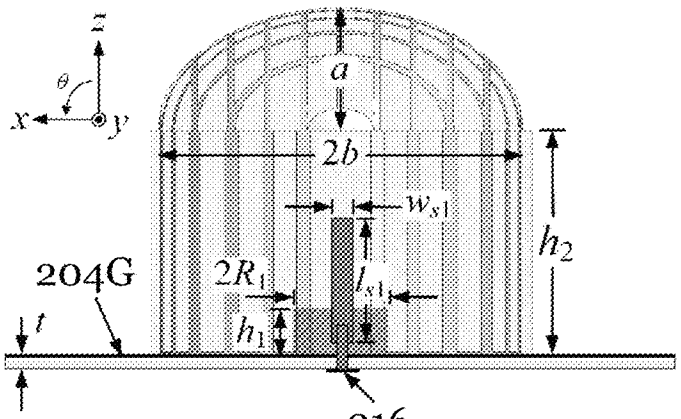
FIG. 2B is a side view of the antenna of FIG. 2A.
Figure 2C:
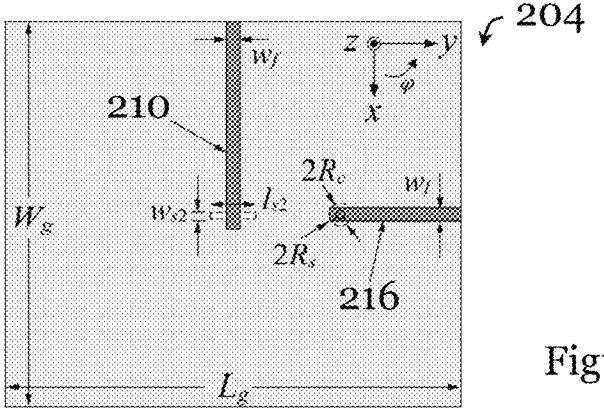
FIG. 2C is a bottom view of the antenna of FIG. 2A.
Figure 2A:
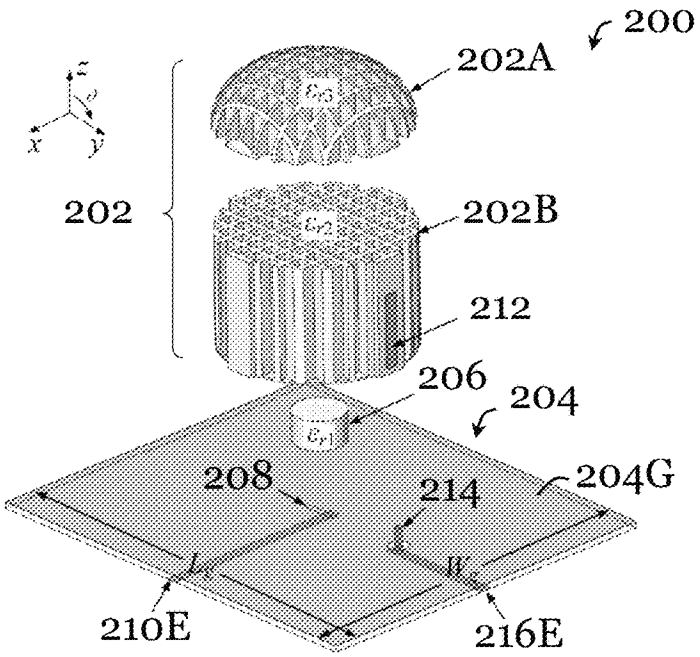
FIG. 2A is an exploded perspective view of an antenna in one embodiment of the invention.

FIGS. 2A to 2C illustrate an antenna 200 in one embodiment of the invention. In this embodiment, the antenna 200 is a dual-frequency-band antenna. The antenna 200 generally includes a dielectric body 202 with a first portion 202A operable as a dielectric lens and a second portion 202B operable as a dielectric resonator, and a feed arrangement operably coupled with the dielectric body for operating the antenna as a dielectric lens antenna and a dielectric resonator antenna. The dielectric body 202 is mounted on a substrate 204. In some embodiments, the first portion 202A is also be operable as a dielectric resonator. The dielectric lens antenna may be arranged to operate at a first frequency band and the dielectric resonator antenna may be arranged to operate at a second frequency band different from (e.g., higher than) the first frequency band.

Referring now to FIGS. 2A and 2B, the first portion 202A is arranged directly above the second portion 202B. The first portion 202A includes a waffle structure formed by ribs intersecting in a decussate manner. The waffle structure that defines a generally dome shaped boundary surface (upper surface) and a generally planar boundary surface (lower surface). In this embodiment, the dome shaped boundary surface is a hemi-ellipsoidal boundary surface (when view from the side as shown in FIG. 2B, an ellipse with major axis b and minor axis a). The ribs are arranged in two arrays. Each of the arrays includes multiple ribs arranged generally in parallel. The ribs in one array cross the ribs in the other array generally perpendicular, with space or voids defined between the ribs. In this embodiment, the thickness of the ribs in the waffle structure are generally the same. The first portion 202A has an effective dielectric constant $\varepsilon_{r_3}$.

The second portion 202B is mounted directly below the first portion 202A, and directly on the substrate 204, i.e., between the first portion 202A and the substrate 204. The second portion 202B supports the first portion. The second portion 202B is mounted at a center portion of the substrate 204 and is generally coaxial with the first portion 202A. The second portion 202B includes a waffle structure that defines a generally cylindrical boundary surface (when view from the side as shown in FIG. 2B, diameter 2*b* and height $h_2$) and a generally planar boundary surface at an upper axial end. The generally planar boundary surface at an upper axial end of the second portion 202B is generally parallel or co-planar with the generally planar boundary surface of the first portion 202A. The waffle structure of the second portion 202B is formed by ribs intersecting in a decussate manner. The ribs are arranged in two arrays. Each of the arrays includes multiple ribs arranged generally in parallel. The ribs in one array cross the ribs in the other array generally perpendicular, with space or voids defined between the ribs. In this embodiment, the thickness of the ribs in the waffle structure are generally the same, and are thicker than the thickness of the ribs in the waffle structure of the first portion 202A. As shown in FIG. 2B, an array of the ribs of the first portion 202A and a corresponding array of the ribs of the second portion 202B generally align. The other array of ribs of the first portion 202A and the other corresponding array of the ribs of the second portion 202B may also generally align. The second portion 202B has an effective dielectric constant $\varepsilon_{r_2}$.

In this embodiment, the first portion 202A defines a first maximum height a, and the second portion 202B defines a second height (or maximum height) $h_2$ larger than the first maximum height a. In this embodiment, the first portion 202A includes a larger air-filling ratio than the second portion 202B due to, e.g., the difference in the thicknesses of the ribs in the two portions. The difference in the air-filling ratios result in the different effective dielectric constants $\varepsilon_{r2}$ and $\varepsilon_{r3}$. The effective dielectric constant $\varepsilon_{r2}$ of the second portion 202B may be larger than (e.g., at least double) the effective dielectric constant $\varepsilon_{r3}$ of the first portion 202A.

The substrate 204 supports the dielectric body 202 as well as the feed arrangement of the antenna 200. The substrate 204 is generally rectangular in plan view, with length $L_g$, width $W_g$, and thickness t. The substrate 204 is a double-sided substrate (e.g., PCB substrate), with a ground plane 204G arranged on the upper surface and an electrically conductive arrangement on the lower surface. In this example, the substrate 204 has a dielectric constant of 3.55 and loss tangent of 0.0027.

In this embodiment, the feed arrangement of the antenna includes a first feed mechanism operably coupled with the dielectric body 202 for operating the antenna as the dielectric lens antenna, as well as a second feed mechanism operably coupled with the dielectric body 202 for operating the antenna as the dielectric resonator antenna.

In this embodiment, the first feed mechanism includes a feed antenna in the form of a slot-coupled dielectric resonator antenna for feeding the first portion 202A (the dielectric lens portion). Referring to FIGS. 2A to 2C, the slot-coupled dielectric resonator antenna includes a dielectric resonator element 206, a coupling slot 208 arranged in the ground plane 204G at the upper surface of the substrate 204, and a straight feedline 210 arranged on the lower surface of the substrate 204.

In this embodiment, the dielectric resonator element 206 is a generally cylindrical, solid element, with radius $R_1$ and height $h_1$. The dielectric resonator element 206 is received by, and substantially enclosed by, the dielectric body 202. The dielectric resonator element 206 is generally coaxial with the dielectric body 202. The dielectric resonator element 206 has a dielectric constant (which is also the effective dielectric constant in this case as the element 206 is solid) $\varepsilon_{r1}$. The dielectric constant $\varepsilon_{r1}$ may be larger than (e.g., at least double) the effective dielectric constant $\varepsilon_{r2}$ of the second portion 202B. In this embodiment, the coupling slot 208 is a generally rectangular slot, with length $l_{s2}$ and width $w_{s2}$, formed in the ground plane 204G. The coupling slot 208 extends generally parallel to the length of the substrate 204. The feedline 210, with width $w_f$, is a substantially straight feedline that extends generally parallel to the width of the substrate 204 (and generally perpendicular to the slot 208). In this example the feedline 210 may be a 50Ω feedline. The end 210E of the feedline 210 is arranged to be connected with a RF connector that provides a feed port. In plan view, the slot 208 is arranged within the footprint of the dielectric resonator element 206, and the slot 208 and the feedline 210 cross generally perpendicularly (the crossing is also within the footprint of the dielectric resonator element 206).

In this embodiment, the second feed mechanism includes an elongated feed strip 212 attached to the second portion 202B, a feedline 216 arranged on the lower surface of the substrate 204, and an electrical conductor, arranged to operate as a signal probe 214, electrically connecting the feed strip 212 and the feedline 216.

In this embodiment, the elongated feed strip 212 is a generally vertical electrically conductive strip attached to a side of the second portion 202B. As an example, the strip 212 can be cut from a double-sided copper tape (with adhesives) and directly stuck onto the dielectric resonator body.

In this embodiment, the feedline 216, with width $w_f$, is a substantially straight feedline that extends generally parallel to the length of the substrate 204 (and generally perpendicular to the feedline 210). In this example, the feedline 216 may be a 50Ω feedline. The end 216E of the feedline 216 is arranged to be connected with a RF connector that provides a feed port. In this embodiment, the signal probe 214 is connected to another end of the feedline 216. The signal probe 214 is generally cylindrical, with radius $R_s$. The signal probe 214 extends generally perpendicular to the substrate 204 and extends through the substrate 204, via a hole with radius $R_c$ formed in the substrate 204. In plan view, the signal probe 214 is arranged generally coaxially with the hole in the substrate 204. The signal probe 214 is connected with the feedline 216 at one end and with the feed strip 212 on one side.

In this embodiment, the antenna 200 is arranged to operate as a dielectric resonator antenna via the dielectric body 202, the dielectric resonator element 206, and the second feed mechanism. The antenna 200 is arranged to operate as a dielectric lens antenna via the dielectric body 202 (in particular the first portion 202A or lens portion) and the second feed mechanism (which includes the dielectric resonator element 206). The first portion 202A can operate as a dielectric lens that affect or change the phase of the incident wavefront from the feed antenna to obtain a high antenna gain. The antenna 200 can selectively or simultaneously operate as a dielectric resonator antenna and a dielectric lens antenna (for communicating with different devices, systems, etc.). The dielectric resonator antenna may operate at a lower band, e.g., X-band, e.g., under $HEM_{11\delta}$ mode. The dielectric lens antenna may operate at a higher band, e.g., S-band.

In this embodiment, the dielectric body 202 and the dielectric resonator element 206 are additively manufactured, e.g., 3D printed. Preferably, the dielectric body 202 and the dielectric resonator element 206 are integrally formed so that they do not need to be assembled after being formed. Various additive manufacturing techniques may be used to make the dielectric body 202 and the dielectric resonator element 206. These techniques include, e.g., fused deposition modeling (FDM), electron beam melting, binder jetting, polymer jetting, selective laser melting, ceramic stereolithography, micro-stereolithography, etc. The dielectric body 202 and the dielectric resonator element 206 may be made by the same material (that has the same dielectric constant), and the effective dielectric constants in different parts of the electric body 202 and/or the dielectric resonator element 206 can be controlled by altering the structure (e.g., different air-filling ratios, 0 may correspond to a solid structure with no space for air or gas).

Table 1 below lists the values of parameters of the antenna 200 shown in FIGS. 2A to 2C. In some embodiments, one or more these values can be different. In some embodiments, one or more these parameters may be not applicable (e.g., if the second portion 202B is not generally cylindrical, if the dielectric resonator element 206 is not generally cylindrical, etc.).

TABLE 1

Values of parameters of the antenna 200

| $\varepsilon_{r1}$ | $\varepsilon_{r2}$ | $\varepsilon_{r3}$ | $L_g$ | $W_g$ | $2R_1$ |
|---|---|---|---|---|---|
| 10 | 5 | 2.5 | 70 mm | 60 mm | 8.4 mm |
| $h_1$ | a | 2b | $h_2$ | $l_{s1}$ | $w_{s1}$ |
| 4.5 mm | 10.2 mm | 30 mm | 18.5 mm | 12 mm | 3.5 mm |
| t | $w_f$ | $l_{s2}$ | $w_{s2}$ | $2R_s$ | $2R_c$ |
| 0.813 mm | 1.95 mm | 4.9 mm | 0.6 mm | 1.27 mm | 2.4 mm |

The software tool ANSYS HFSS can be used to assist with the design of the antenna in one embodiment of the invention. To speed up the design process, a corresponding solid dual-frequency-band antenna can be considered and analyzed.

Figure 3B:
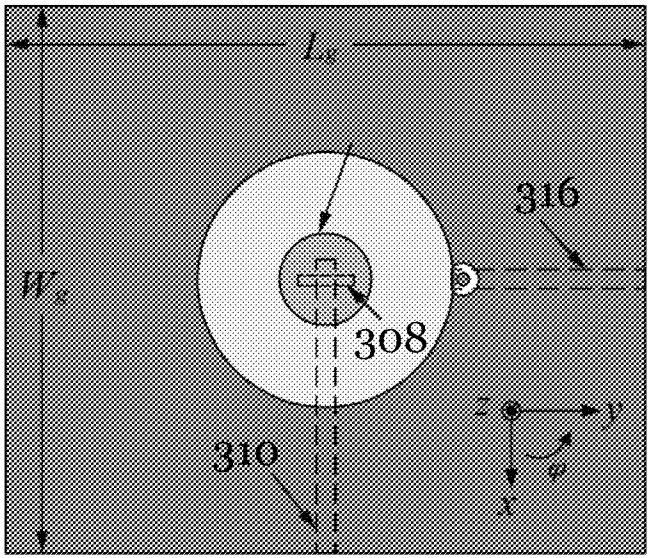
FIG. 3B is a bottom view of the antenna of FIG. 3A.
Figure 3A:
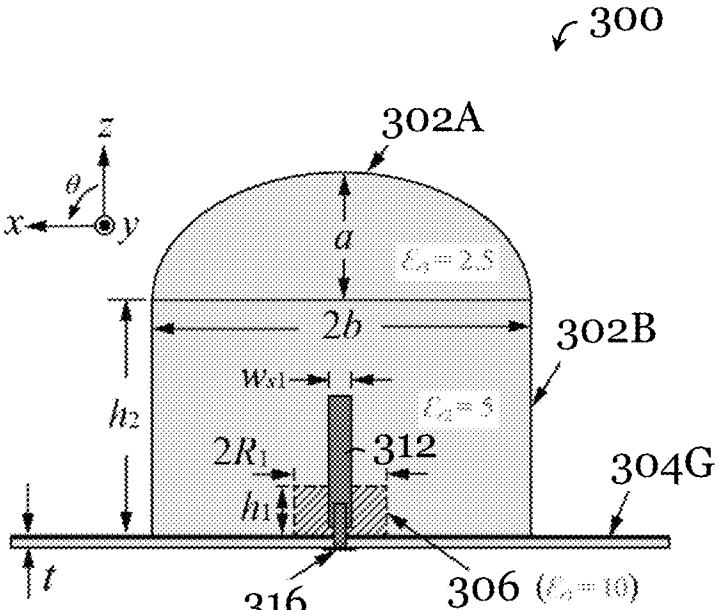
FIG. 3A is a side view of an antenna in one embodiment of the invention.

FIGS. 3A and 3B show a configuration of a solid dual-frequency-band antenna 300. The antenna 300 has substantially the same structure as the antenna 200 except that the waffle structure of the dielectric body is made solid. Like references (the references of FIG. 2+"100") are used in FIG. 3 to refer to corresponding structures in FIG. 2.

As shown in FIG. 3A, a small feeding cylindrical dielectric resonator element (antenna) 306 is embedded inside a low-band cylindrical dielectric resonator 302B. The element 306 has a dielectric constant of $\varepsilon_{r1}$=10. As compared with a patch antenna, the utilization of the feeding cylindrical dielectric resonator element (antenna) 306 can reduce conduction loss and provide higher efficiency in the high-band. Placed above the low-frequency-band cylindrical dielectric resonator 302B is the lens 302A of the dielectric lens antenna, which has a dielectric constant $\varepsilon_{r3}$ of 2.5.

In this embodiment, the larger cylindrical dielectric resonator 302B, which constitutes a major portion of the low-band dielectric resonator antenna, is designed with a dielectric constant $\varepsilon_{r2}$ of 5 to make the low-band dielectric resonator antenna efficiently resonant. The larger cylindrical dielectric resonator 302B is also used as a support for the high-band dielectric lens 302A. The cylindrical dielectric resonator 302B is excited by a vertical conductive strip 312 stuck on a sidewall of the low-band cylindrical dielectric resonator 302B.

Table 2 below lists the values of parameters of the antenna 300 shown in FIGS. 3A and 3B. In some embodiments, one or more these values can be different. In some embodiments, one or more these parameters may be not applicable.

TABLE 2

Values of parameters of the antenna 300

| $\varepsilon_{r1}$ | $\varepsilon_{r2}$ | $\varepsilon_{r3}$ | $L_g$ | $W_g$ | $2R_1$ |
|---|---|---|---|---|---|
| 10 | 5 | 2.5 | 70 mm | 60 mm | 8.4 mm |
| $h_1$ | a | 2b | $h_2$ | $w_{s1}$ | t |
| 4.5 mm | 9.52 mm | 28 mm | 18.5 mm | 2 mm | 0.813 mm |

Figure 4:
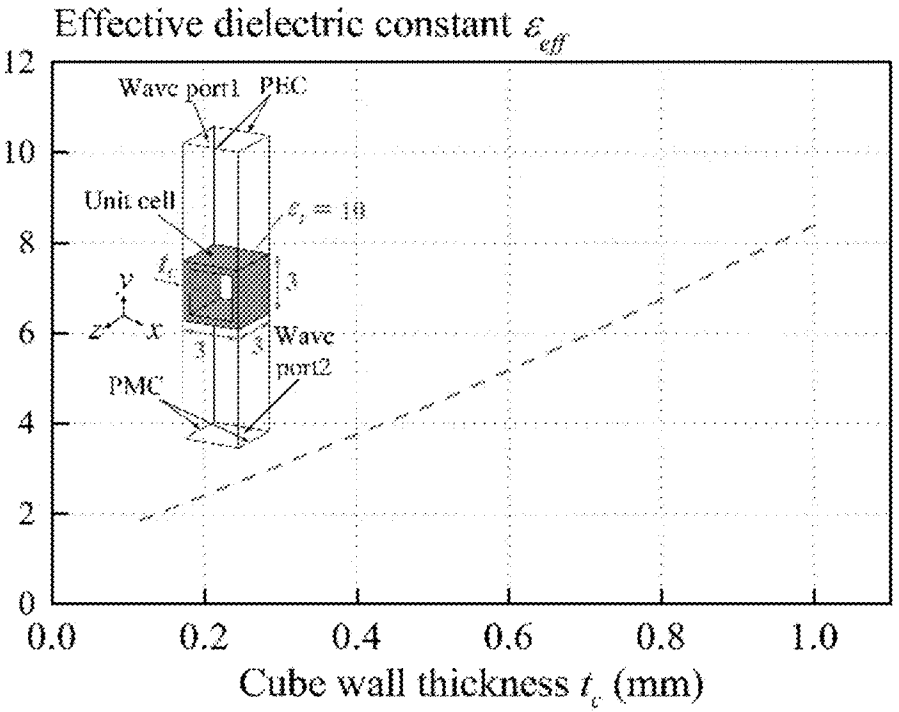
FIG. 4 is a graph showing the relationship between an effective dielectric constant $\varepsilon_{eff}$ a cubic unit cell and thickness $t_c$ (mm) of the wall of the cubic unit cell.

The inventors of the invention have realized that it may be convenient to additively manufacture (e.g., 3D print) an inhomogeneous antenna using a single printing material. In one example, a 3D printing material with a dielectric constant of 10±0.35 over 0.1-18 GHz is used. In the simulation, $\varepsilon_{r1}=10$ is used, and the effective dielectric constants approach disclosed in X. Chen, T. M. Grzegorczyk, B. I. Wu, J. Pacheco, Jr., and J. A. Kong, "Robust method to retrieve the constitutive effective parameters of metamaterials," *Phys. Rev. E*, vol. 70, 2004, Art. no. 016608 is used to obtain $\varepsilon_{r2}=5$ and $\varepsilon_{r3}=2.5$. In this approach, a cubic unit cell with a dielectric constant of 10 is introduced. FIG. 4 shows the extracted effective dielectric constant of the cube unit cell for different cube thicknesses $t_c$ at 10 GHz. The inset shows the unit cell configuration and the boundary setting in the simulation. With reference to the inset in FIG. 4, the unit cell has a wall thickness $t_c$ and fixed side length of 3 mm or $0.1\lambda_0$, where $X_0$ is the wavelength in air at 10 GHz. To extract the effective dielectric constant of the unit cell, a retrieval method based on S-parameters, as disclosed in D. R. Smith, D. C. Vier, T. Koschny, and C. M. Soukoulis, "Electromagnetic parameter retrieval from inhomogeneous metamaterials," *Phys. Rev. E*, vol. 71, 2005, Art. no. 036617, is adopted:

$$n = \frac{1}{kd}\cos^{-1}\left[\frac{1}{2S_{21}}\left(1 - S_{11}^2 + S_{21}^2\right)\right] \tag{1}$$

$$z = \sqrt{\frac{(1+S_{11})^2 - S_{21}^2}{(1-S_{11})^2 - S_{21}^2}} \tag{2}$$

$$E_{eff} = n/z = \varepsilon' - j\varepsilon'' \tag{3}$$

where k, d, n, z, and $\varepsilon_{eff}$ are the wavenumber, unit cell thickness, refractive index, wave impedance, and effective permittivity of the unit cell, respectively In this example, the S-parameters of the unit cell are simulated with ANSYS HFSS. In the simulation, a periodic structure of the unit cell is considered. It is realized by placing it in a waveguide with perfect magnetic and electric boundaries, as shown in the inset in FIG. 4. FIG. 4 shows the extracted effective dielectric constant as a function of the wall thickness of the unit cell. It can be seen that the effective dielectric constant $\varepsilon_{eff}$ of the unit cell can be modified by controlling the wall thickness $t_c$. In one example, the wall thicknesses of 0.55 mm and 0.22 mm are used to obtain $\varepsilon_{r2}=5$ and $\varepsilon_{r3}=2.5$, respectively.

As mentioned, the antenna in some embodiments (e.g., the antenna 200, 300) can operate as a low-band dielectric resonator antenna. In the following, the low-band dielectric resonator antenna, provided by antenna 300, is studied.

Figure 5:
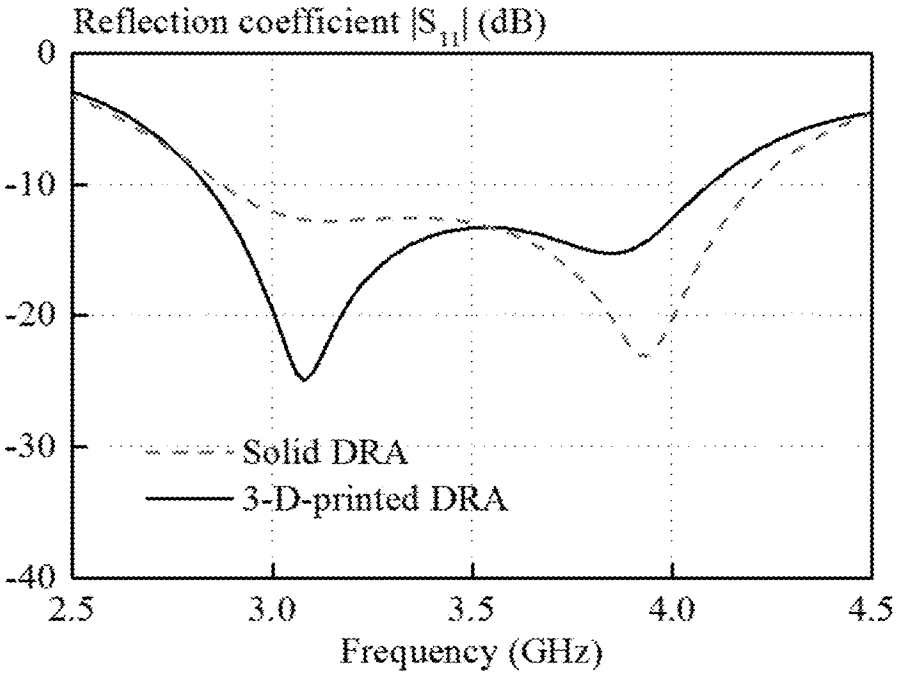
FIG. 5 is a graph showing simulated reflection coefficient $|S_{11}|$ (dB) of a solid dielectric resonator antenna (the antenna of FIG. 3 operating as a dielectric resonator antenna) and a corresponding 3D-printed dielectric resonator antenna (the antenna of FIG. 2 operating as a dielectric resonator antenna), at different frequencies (2.5 GHz to 4.5 GHz)

FIG. 5 shows simulated reflection coefficient $|S_{11}|$ (dB) of a solid dielectric resonator antenna (the antenna of FIG. 3 operating as a dielectric resonator antenna, labelled as "Solid DRA") and a corresponding 3D-printed dielectric resonator antenna (the antenna of FIG. 2 operating as a dielectric resonator antenna, labelled as "3D-printed DRA"), at different frequencies (2.5 GHz to 4.5 GHz). FIG. 5 shows that the two simulations results are in reasonable agreement. One reason for the small discrepancy in the two results is that only partial unit cells can be constructed at the boundaries of the 3D-printed antenna (to follow the cylindrical contour of the solid antenna), and these partial unit cells inevitably affect the values of the realized effective dielectric constants. The comparison result illustrates that the solid antenna can be applied as an initial design, or an alternative design, for the 3D-printed antenna.

To study the two minima of the reflection coefficients (the $|S_{11}|$ curves) in FIG. 5, a parametric study is performed.

Figure 6:
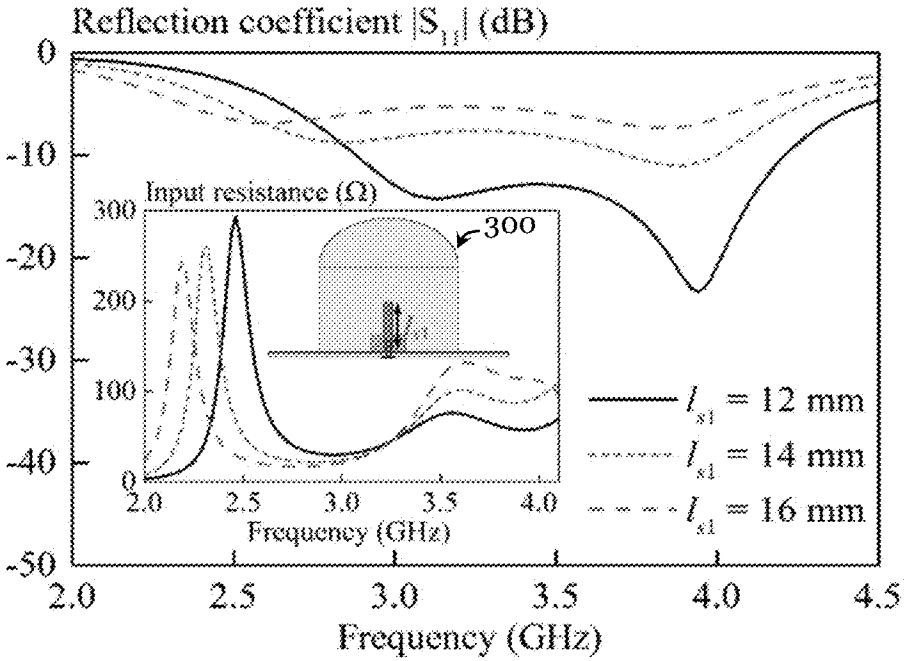
FIG. 6 is a graph showing simulated reflection coefficient $|S_{11}|$ (dB) as well as input resistance (Ω) (inset graph) of the solid dielectric resonator antenna at different frequencies (2.0 GHz to 4.5 GHz) for different conductive strip lengths $l_{S1}$ (12 mm, 14 mm, 16 mm)

FIG. 6 shows the reflection coefficient $|S_{11}|$ (dB) as well as input resistance (n) (inset graph) of the solid antenna 300 operating as a dielectric resonator antenna at different frequencies (2.0 GHz to 4.5 GHz) for different conductive strip lengths $l_{s1}$ (12 mm, 14 mm, and 16 mm).

As shown in FIG. 6, the frequency of the first local minimum shifts downwards as $l_{s1}$ increases. For the second minimum, $l_{s1}$ affects more the matching level than the frequency. This would suggest that the first minimum is due to the strip loading that changes the impedance level, and the second minimum is directly associated with the resonance of the dielectric resonator antenna. The inset in FIG. 6 shows the input resistance of the antenna 300 (when operated as a low-band dielectric resonator antenna) for different feed strip lengths $l_{s1}$. It can be seen that when the strip length $l_{s1}$ increases from 12 mm to 16 mm, the frequency of the first peak resistance decreases and the frequency of the second peak resistance remains about the same. This would suggest that the first resonance is influenced by the strip loading and the second resonance is due to the dielectric resonator antenna mode. To verify this conclusion, the effect of the diameter 2*b* of the antenna 300 (when operated as a low-band dielectric resonator antenna) on the reflection coefficient is studied.

Figure 7:
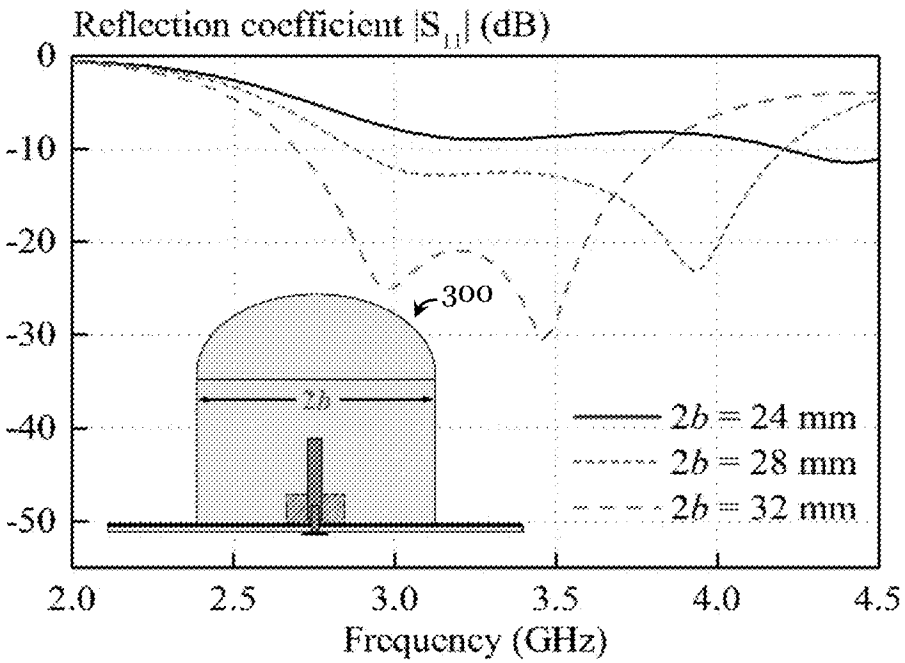
FIG. 7 is a graph showing simulated reflection coefficient $|S_{11}|$ (dB) of the solid dielectric resonator antenna at different frequencies (2.0 GHz to 4.5 GHz) for different diameters 2*b* (24 mm, 28 mm, 32 mm)

FIG. 7 shows simulated reflection coefficient $|S_{11}|$ (dB) of the solid antenna 300 operating as a dielectric resonator antenna at different frequencies (2.0 GHz to 4.5 GHz) for different diameters 2*b* (24 mm, 28 mm, 32 mm).

As shown in FIG. 7, as the value of 2*b* increases from 24 mm to 32 mm, the frequency of the first local minimum remains about the same and the frequency of the second local minimum decreases rather significantly. One reason for this is that a larger resonator (resonator element, related to the value of 2*b*) has a lower resonant frequency. The results in FIG. 7 supports the conclusion that the second minimum is directly associated with the resonance of the dielectric resonator antenna.

FIGS. 8A and 8B show the simulated electric field (E-field) distribution of the solid antenna 300 operating as a low-band dielectric resonator antenna at the frequencies of the first (3.12 GHz) and second (3.94 GHz) local minima of $|S_{11}|$. As shown in FIGS. 8A and 8B, a $HEM_{11\delta}$-mode field distribution of a cylindrical dielectric resonator antenna (the second portion) are observed at both frequencies. This suggests that the low-band radiation mainly arises from the dielectric resonator antenna resonant mode, and not the vertical feed strip (monopole) mode, thus providing a desirable broadside radiation pattern.

Although not specifically illustrated, the effect of the low-band dielectric resonator 302B height $h_2$ on the antenna performance in the two bands is investigated. It is found that the resonant frequency of the low-band dielectric resonator 302B shifts downwards as $h_2$ increases. This can be expected because the resonant frequency is inversely proportional to the radiator size. Due to the loading effect of the low-band dielectric resonator, its height would affect the high-band antenna impedance matching and gain. In one embodiment, the optimum height $h_2$ of the low-band dielectric resonator is 18.5 mm.

As mentioned, the antenna in some embodiments (e.g., the antenna 200, 300) can operate as a high-band dielectric lens antenna. In the following the high-band dielectric lens antenna, provided by antenna 300, is studied.

In this study, initially, the following are studied: a slot-coupled cylindrical dielectric resonator element/antenna designed as a reference/feed antenna, and a high-band dielectric lens antenna with the reference antenna (and without the low-band feed strip). These designs generally correspond to that (some of the parts) in antenna 300.

Figure 9A:
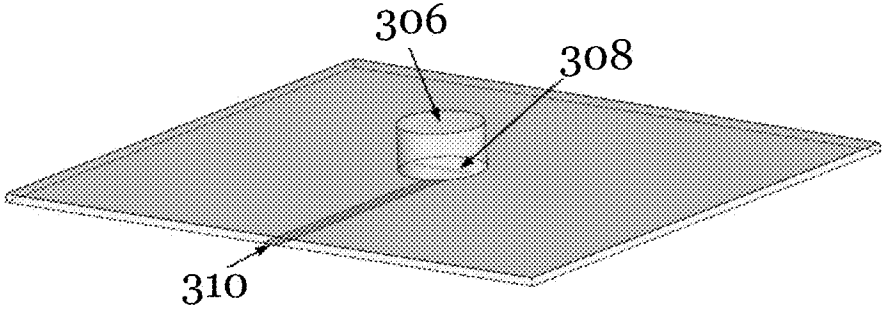
FIG. 9A is a perspective view of a feed antenna for feeding a dielectric lens antenna (the antenna of FIG. 3 operating as a dielectric lens antenna) in one embodiment of the invention.
Figure 9B:
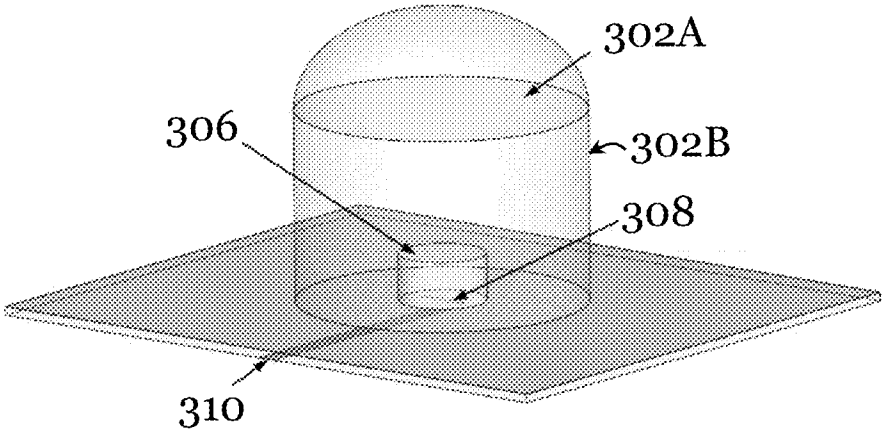
FIG. 9B is a perspective view of a dielectric lens antenna (the antenna of FIG. 3 operating as a dielectric lens antenna) including the feed antenna of FIG. 9A in one embodiment of the invention.

FIG. 9A shows the feed antenna, i.e., the reference slot-coupled dielectric resonator antenna and FIG. 9B shows the dielectric lens antenna with the feed antenna of FIG. 9A. As described above, the dielectric resonator element 306 is substantially enclosed by the cylindrical dielectric resonator 302B. For the avoidance of doubt, in this example, the values of the parameters in FIGS. 9A and 9B are the same as those in FIG. 3.

Figure 10:
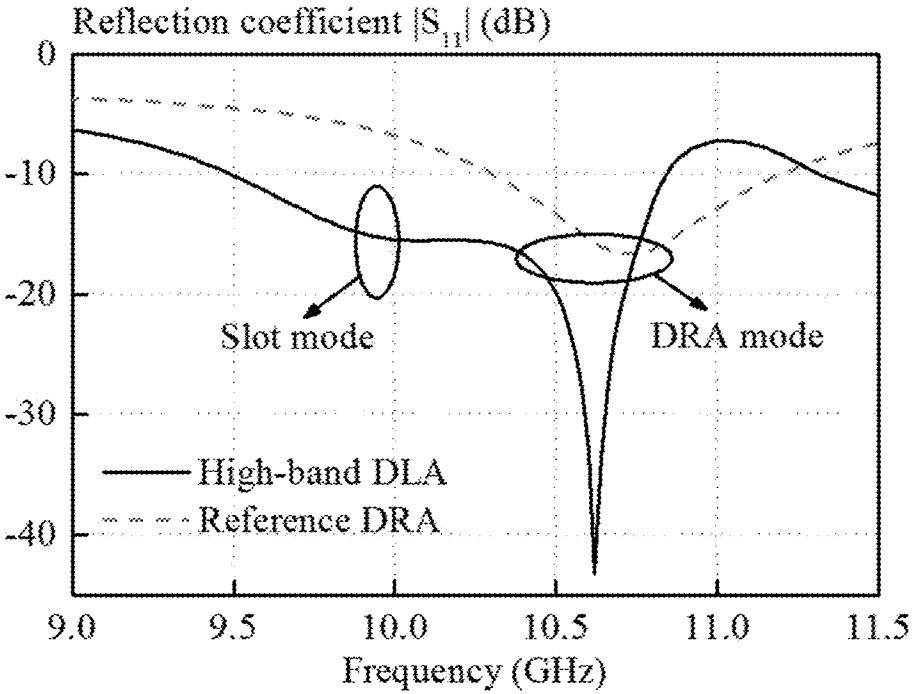
FIG. 10 is a graph showing simulated reflection coefficient $|S_{11}|$ (dB) of the feed antenna of FIG. 9A (labelled as "Reference DRA") and the dielectric lens antenna of FIG. 9B (labelled as "High-band DLA") at different frequencies (9.0 GHz to 11.5 GHz)

FIG. 10 shows the simulated reflection coefficients of the reference dielectric resonator antenna in FIG. 9A and the dielectric lens antenna in FIG. 9B. As shown in FIG. 10, two local minima can be observed in the $|S_{11}|$ curve of the dielectric lens antenna.

To study the two minima of the reflection coefficients (the $|S_{11}|$ curves) in FIG. 10, a parametric study is performed.

Figure 11:
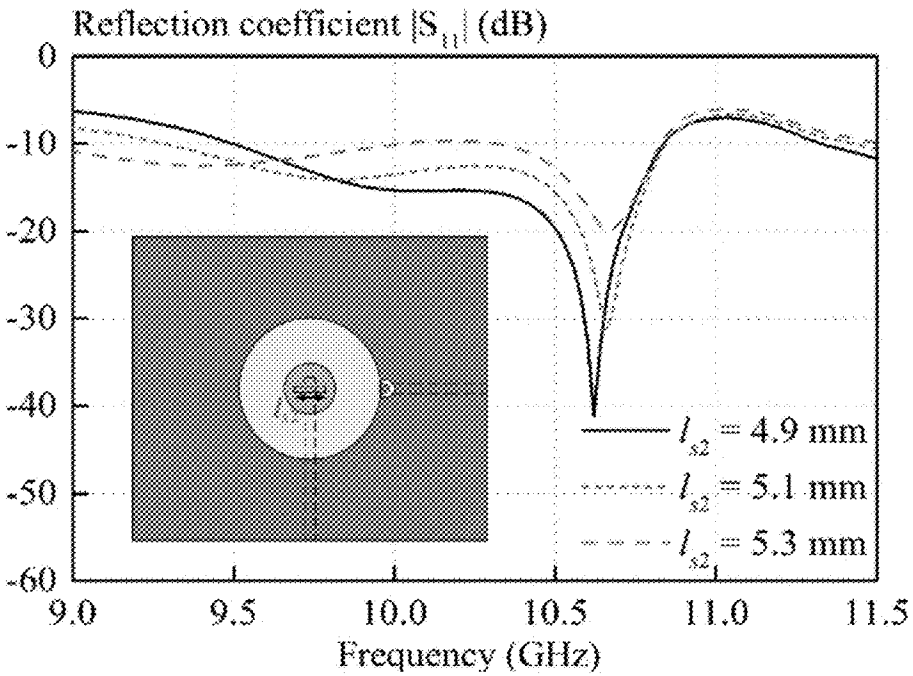
FIG. 11 is a graph showing simulated reflection coefficient $|S_{11}|$ (dB) of the dielectric lens antenna at different frequencies (9.0 GHz to 11.5 GHz) for different coupling slot lengths $l_{S2}$ (4.9 mm, 5.1 mm, 5.3 mm)

FIG. 11 shows the simulated reflection coefficient $|S_{11}|$ (dB) of the dielectric lens antenna at different frequencies (9.0 GHz to 11.5 GHz) for different coupling slot lengths $l_{s2}$ (4.9 mm, 5.1 mm, 5.3 mm). The values of the other parameters are the same as those in FIG. 3. As shown in FIG. 11, as the slot length increases from 4.9 mm to 5.3 mm, the frequency of the first local minimum shifts from 9.9 GHz downwards to 9.4 GHz, and the frequency of the second local minimum remains about the same. This suggests that the first minimum is due to the coupling slot modes and the second minimum is caused by the feed dielectric resonator antenna mode. To verify this, the effect of the feeding dielectric resonator element height $h_1$ on the reflection coefficient is studied.

Figure 12:
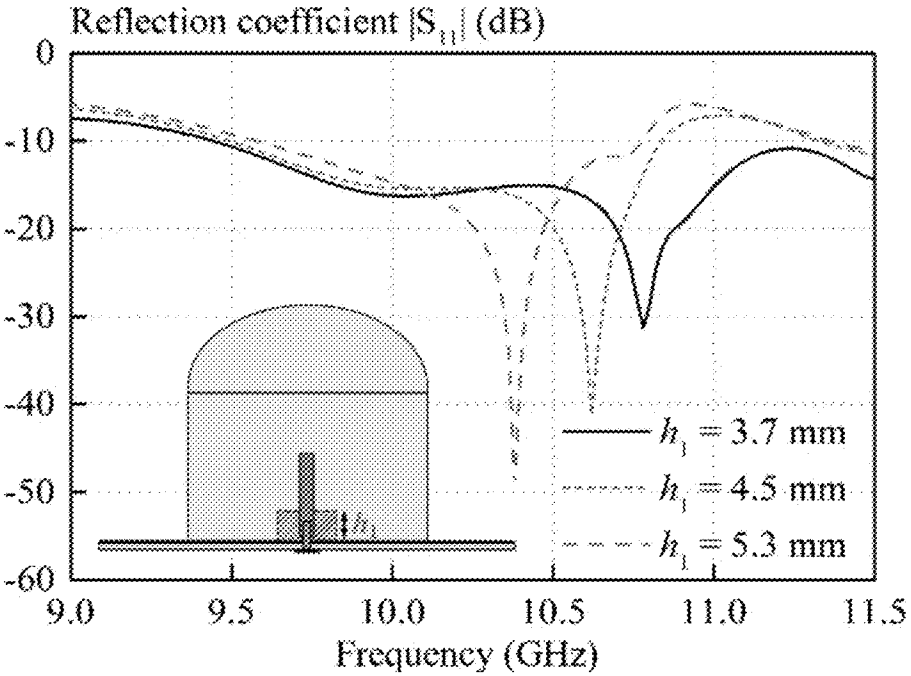
FIG. 12 is a graph showing simulated reflection coefficient $|S_{11}|$ (dB) of the dielectric lens antenna at different frequencies (9.0 GHz to 11.5 GHz) for different feed antenna dielectric resonator element heights $h_1$ (3.7 mm, 4.5 mm, 5.3 mm)

FIG. 12 shows the simulated reflection coefficient $|S_{11}|$ (dB) of the dielectric lens antenna at different frequencies (9.0 GHz to 11.5 GHz) for different feed antenna dielectric resonator element heights $h_1$ (3.7 mm, 4.5 mm, 5.3 mm). The values of the other parameters are the same as those in FIG. 3. As shown in FIG. 12, the feeding dielectric resonator element height $h_1$ has a larger effect on the frequency of the second local minimum but a smaller effect on the frequency of the first local minimum. This result further suggests that the first and second local minima are associated with the coupling slot and feeding dielectric resonator antenna/element, respectively.

As shown in FIG. 10, the reference dielectric resonator antenna resonates at 10.64 GHz, which is near the second minimum of the dielectric lens antenna (10.58 GHz). This facilitates the dielectric lens antenna design because the feeding antenna can be designed as if the low-band dielectric resonator and the high-band dielectric lens are not present. It is worth mentioning that due to the loading effect of the outer dielectric parts (low-band cylindrical dielectric resonator 302B and high-band dielectric lens 302A), the slot and dielectric resonator antenna modes of the high-band dielectric lens antenna are merged and thus providing a wide impedance bandwidth. Also, the high-band dielectric lens antenna can be matched by changing the coupling slot length.

The effect of the high-band feed antenna height on the low-band antenna performance is investigated. It is found that the feed antenna height has substantially no effect on the low-band antenna impedance matching and gain. These results are desirable because the high-band antenna can be optimized without affecting the low-band antenna performance.

Figure 13:
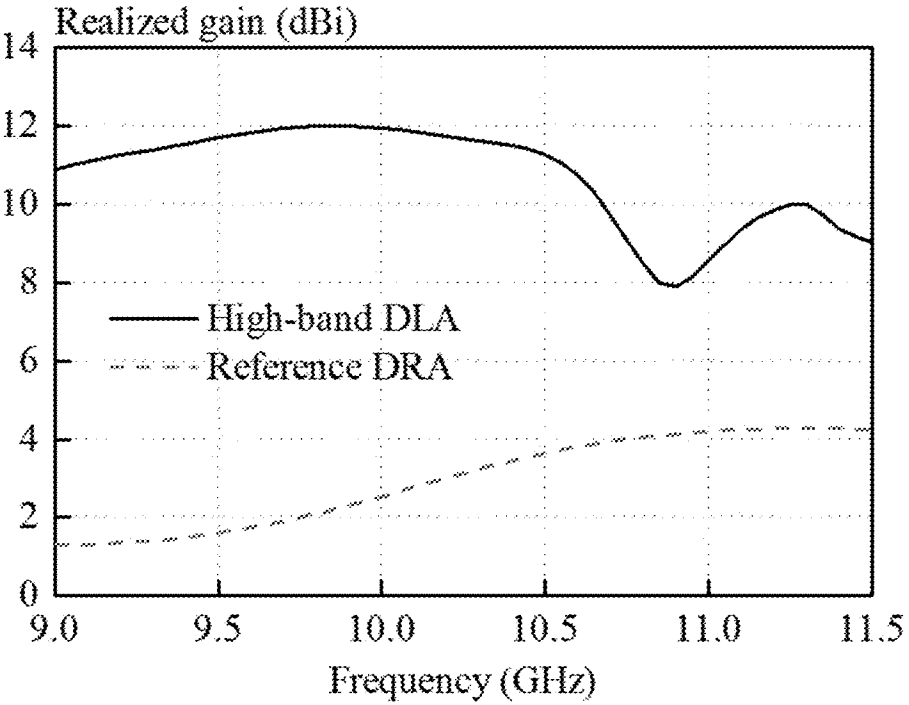
FIG. 13 is a graph showing simulated boresight antenna gains (dBi) of the feed antenna of FIG. 9A (labelled as "Reference DRA") and the dielectric lens antenna of FIG. 9B (labelled as "High-band DLA") at different frequencies (9.0 GHz to 11.5 GHz)

FIG. 13 shows simulated boresight antenna gains (dBi) of the feed antenna of FIG. 9A (labelled as "Reference DRA") and the dielectric lens antenna of FIG. 9B (labelled as "High-band DLA") at different frequencies (9.0 GHz to 11.5 GHz).

With reference FIG. 13, the boresight antenna gain of the dielectric lens antenna is higher than that of the reference dielectric resonator antenna by ~9 dB at 10.25 GHz. It should be mentioned that due to the large ground plane effect, the boresight gain of the reference dielectric resonator antenna is lower than that of a dielectric resonator antenna with a small ground plane. As can be seen from FIG. 13, the boresight gain of the high-band dielectric lens antenna drops at the upper-edge frequency band. This is because, at higher frequencies, the low-band dielectric resonator will have a stronger loading effect on the feed antenna, which leads to more electromagnetic waves transmitting to the sidewall of the low-band dielectric resonator. However, these waves cannot be collimated in the boresight direction but instead propagate laterally, thus decreasing the antenna boresight gain.

Figure 14:
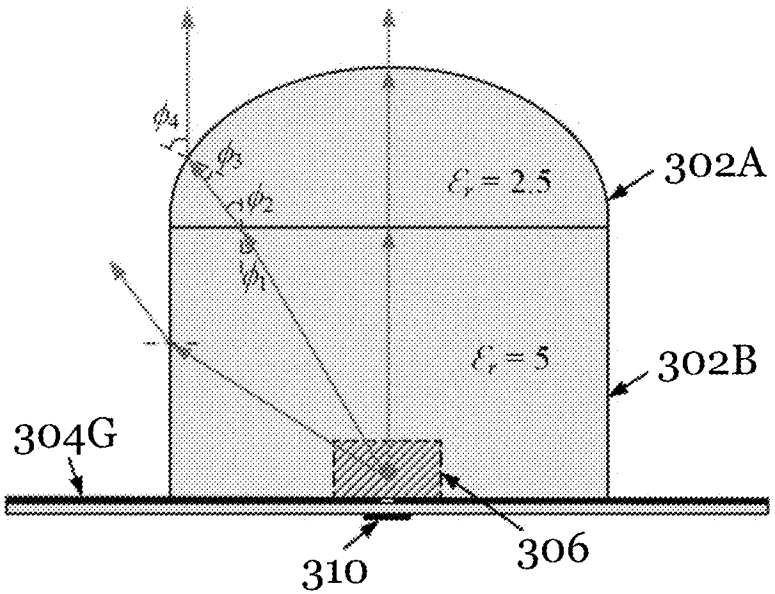
FIG. 14 is a schematic diagram illustrating wave passing through the dielectric lens portion of the dielectric lens antenna in one embodiment of the invention.

To explain the beam collimating property of the high-band dielectric lens antenna, FIG. 14 illustrates three possible wave paths from the feed antenna (dielectric resonator element 306) passing through the dielectric lens portion 302A of the dielectric lens antenna (the antenna 300 operating as a dielectric lens antenna) in one embodiment of the invention. For ease of analysis, the feed antenna is replaced by a point source (dot inside element 306). As shown in FIG. 14, in Path 1, the wave is emitted from the feed antenna and comes out from the dielectric lens portion top surface by refractions. In Path 2, the wave comes out of the dielectric lens portion top surface without refraction. In Path 3, the wave comes out from the sidewall of the low-band cylindrical dielectric resonator 302B. With reference to Path 1, by Snell's refraction law, the following relationship can be obtained: $\emptyset_4>\emptyset_3$. Hence, by properly shaping the dielectric lens portion contour or boundary, the outgoing wave from Path 1 can be controlled to be parallel to that from Path 2. This means that the antenna beam can be collimated in the boresight direction. As a result, the boresight antenna gain is enhanced. It is noted that only the rays that hit the lens surface can be collimated. In one design, the lens can be optimized as a half-split elliptical shape to improve or maximize the antenna gain.

Figure 15:
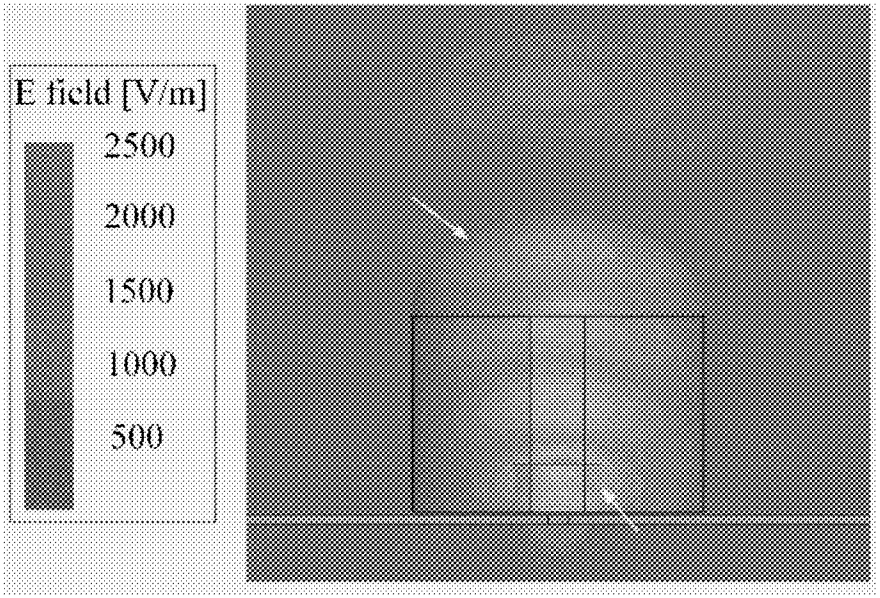
FIG. 15 is a plot showing simulated electric field transmission from the feed antenna to the dielectric lens antenna.

FIG. 15 shows the simulated electric field (E-field) transmitting from the high-band feed antenna (element 306) to the dielectric lens portion 302A at 10.2 GHz. As shown in FIG. 15, the electromagnetic wave passing through the dielectric lens portion 302A is well collimated toward the boresight direction, thus giving a high antenna gain.

Figure 16B:
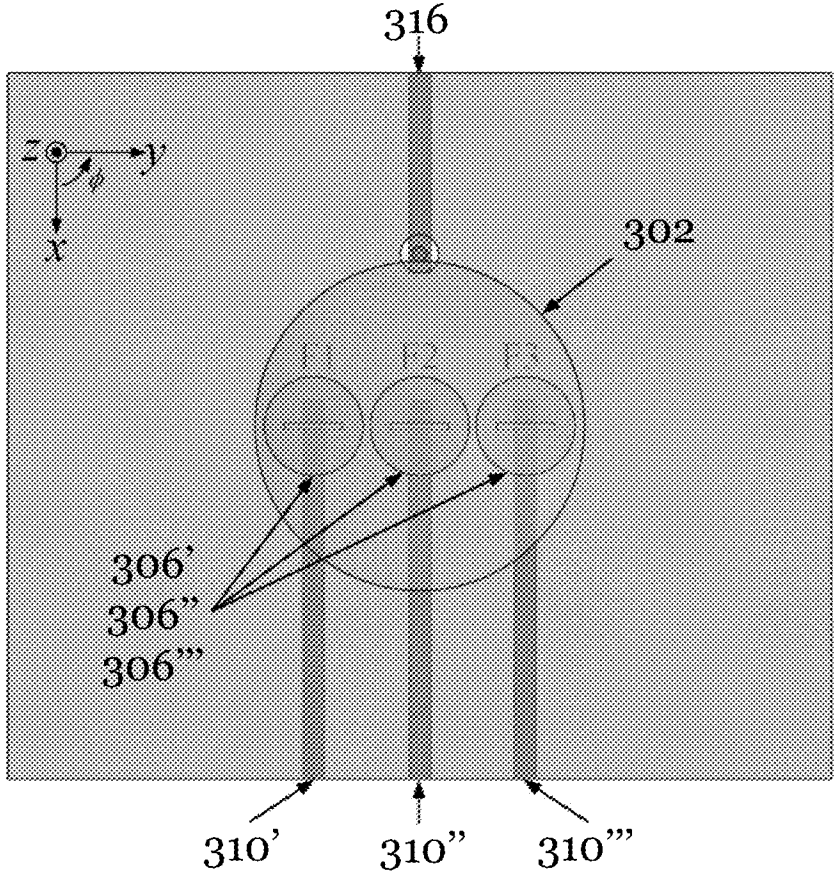
FIG. 16B is a top view of the antenna of FIG. 16A.
Figure 16A:
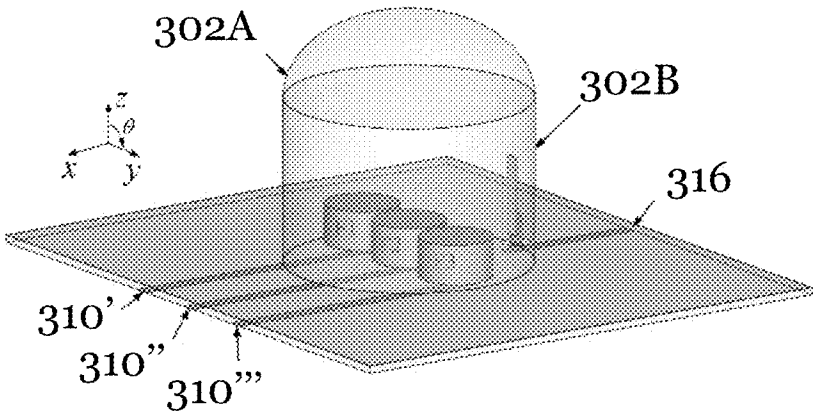
FIG. 16A is a perspective view of an antenna in one embodiment of the invention.

The inventors of the invention have devised that by using multiple feed antennas, a high-band dielectric lens antenna with a steerable beam can be obtained. FIGS. 16A and 16B illustrate one possible beamsteering configuration with three feed antennas F1, F2, F3. The feed antennas F1, F2, F3 can have the same construction of the feed antenna illustrated in FIG. 9A. Like references are used in FIGS. 16A and 16B to refer to corresponding structures in FIG. 9A. Referring to FIGS. 16A and 16B, the low-band feed network is designed in the x-z plane to reduce its effect on the beamsteering performance of the high-band antenna.

Figure 17:
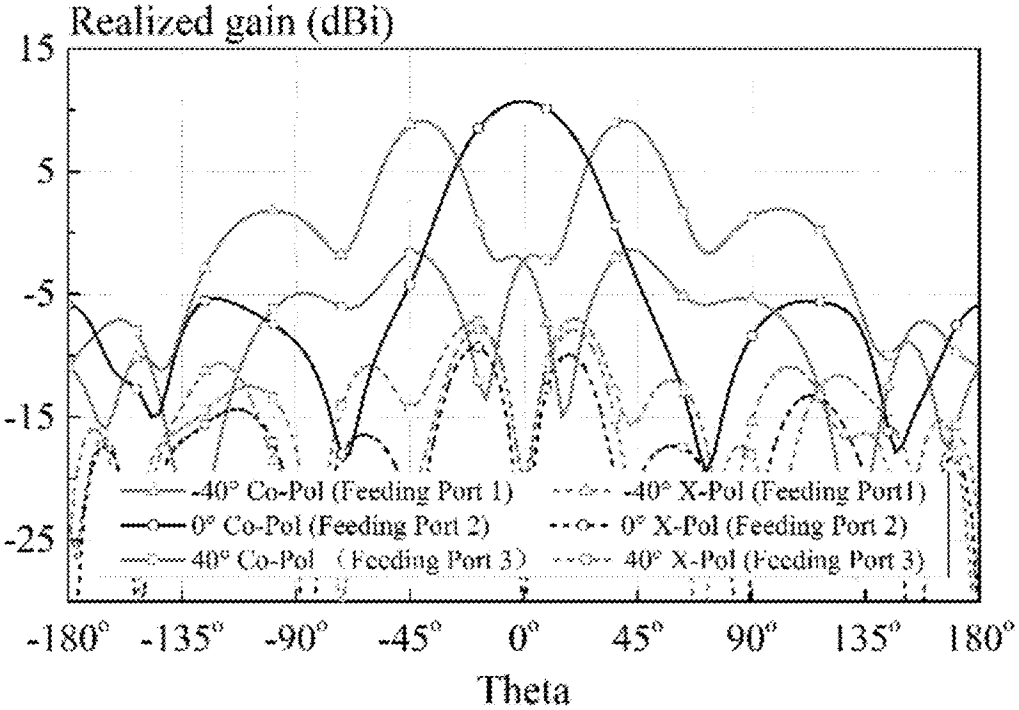
FIG. 17 is a graph showing simulated antenna gains (dBi) of the feed antenna of FIG. 16A when fed at different ports (1, 2, 3) at 10.2 GHz.

FIG. 17 shows the beamsteering results obtained using the design of FIGS. 16A and 16B. As shown in FIG. 17, sequentially feeding from Port 1 to Port 3, the main beam of the high-band antenna can steer from −40° to +400 in the elevation plane with a gain fluctuation less than 2 dBi. This configuration facilitates establishment of communication link between the high-band antenna and an external device (e.g., satellite), especially when the external device is not in the boresight direction. Also, it is found that the low-band dielectric resonator antenna still provides satisfactory performance. This can be expected because the high-band feed antenna has a small volume, thus having little effect on the low-band antenna. Further details are not included here for brevity.

Figure 18B:
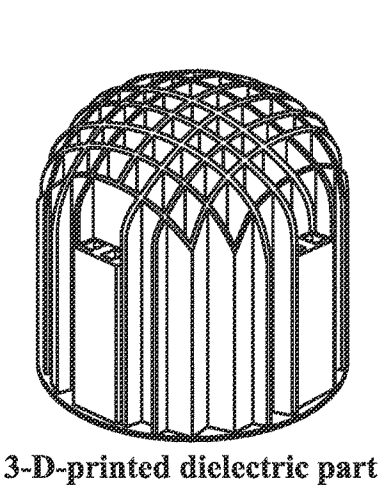
FIG. 18B is a photograph of a dielectric body of the antenna of FIG. 18A.
Figure 18A:
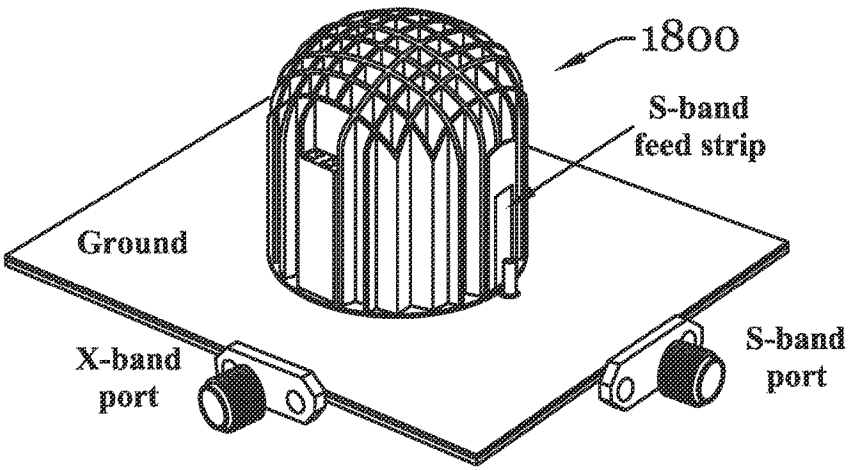
FIG. 18A is a photograph of a prototype of an antenna in one embodiment of the invention.
Figure 18C:
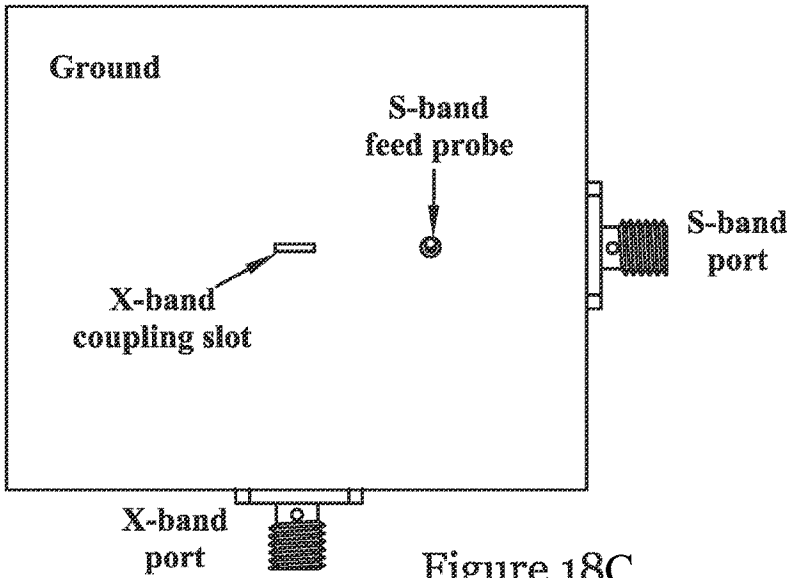
FIG. 18C is a photograph of a substrate (top surface with ground) of the antenna of FIG. 18A.

FIGS. 18A to 18C show a prototype of a dual-frequency-band antenna 1800 in one embodiment of the invention. The dual-frequency-band antenna 1800 is made based on the design of the antenna 200 of FIG. 2, with generally the same structure as the antenna 200 in FIG. 2. The antenna 1800 is operable as a dielectric resonator antenna and a dielectric lens antenna. The antenna 1800 is arranged to operate in the sub-6 GHz 5G band (S-band or 3.3 GHz to 3.6 GHz) and the mobile-service band (X band or 10 GHZ to 10.5 GHz). A fused deposition modeling (FDM) 3D printer with a printing resolution of 0.05 mm and tolerance of 0.1 mm is used for making the antenna 1800. To facilitate detaching the printed dielectric part (dielectric body and dielectric resonator element of the feed antenna) from the printing platform, a thin dielectric layer with a radius of 15 mm and thickness of 0.3 mm is printed beneath the dielectric part. During the 3D printing process, the antenna is built in a layer-by-layer fashion. Generally a thinner printing layer can give a more accurate model and will take longer printing time. In this example, each printing layer is fixed at 0.3 mm and the dielectric part of the antenna is printed in about 2 hours. The antenna is firmly bonded on the substrate with adhesives (e.g., glue).

The antenna 1800 is tested. In the experiment, the S-parameters of the antenna 1800 are measured with an Agilent N5230A vector network analyzer, and the radiation patterns, antenna gains, and total antenna efficiencies (mismatch also considered) of the antenna 1800 are measured with a Satimo StarLab system.

As mentioned, the antenna 1800 is operable as an S-band dielectric resonator antenna.

Figure 19:
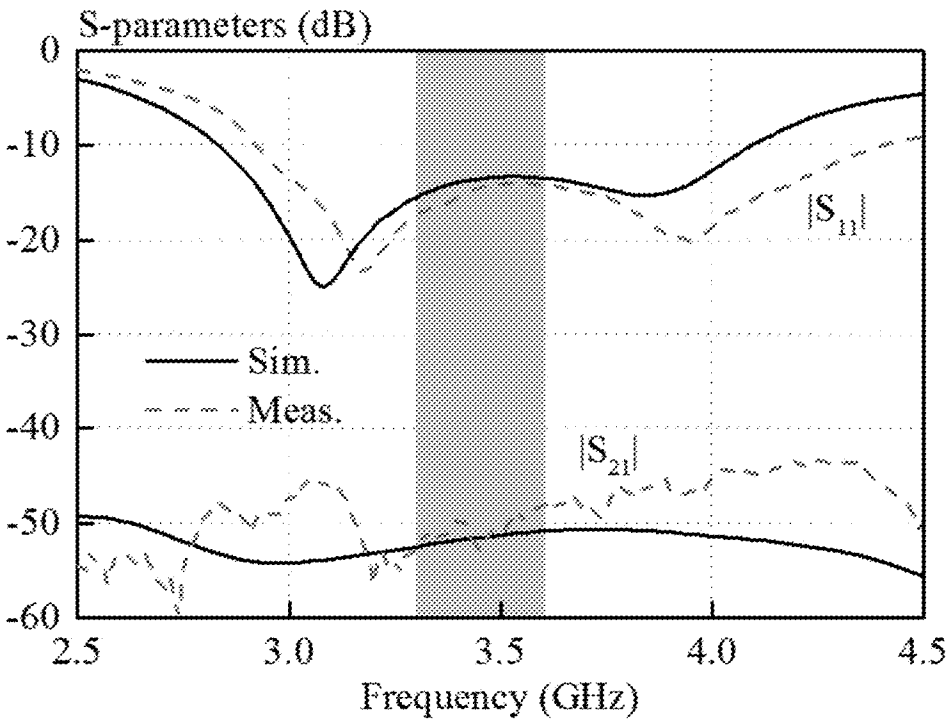
FIG. 19 is a graph showing simulated and measured S-parameters $|S_{11}|$ and $|S_{21}|$ (dB) of the antenna of FIG. 18A (operating as an S-band dielectric resonator antenna) at different frequencies (2.5 GHz to 4.5 GHz)

FIG. 19 shows the measured and simulated S-parameters (reflection coefficients and port isolations) of the antenna 1800 operating as an S-band dielectric resonator antenna at different frequencies (2.5 GHz to 4.5 GHz). The values of the parameters are the same as those in the antenna 200 of FIG. 2. As shown in FIG. 19, the measured 10-dB impedance bandwidth ($|S_{11}|\leq-10$ dB) is 40.2% (2.92 GHz to 4.39 GHz), which generally agrees with the simulated result of 37.8% (2.87 GHz to 4.21 GHz). Both results can support the 5G network-based V2X communications (3.3 GHz to 3.6 GHz). Also, in FIG. 19, both the measured and simulated results of $|S_{21}|$ are below −40 dB across the impedance passband. Such high port isolations can be expected because the (embedded) feeding dielectric resonator antenna/element for the higher band is electrically too small to be an effective radiator in the lower frequency band. In addition, the polarizations of the dielectric resonator antenna and dielectric lens antenna are generally orthogonal.

Figure 20A:
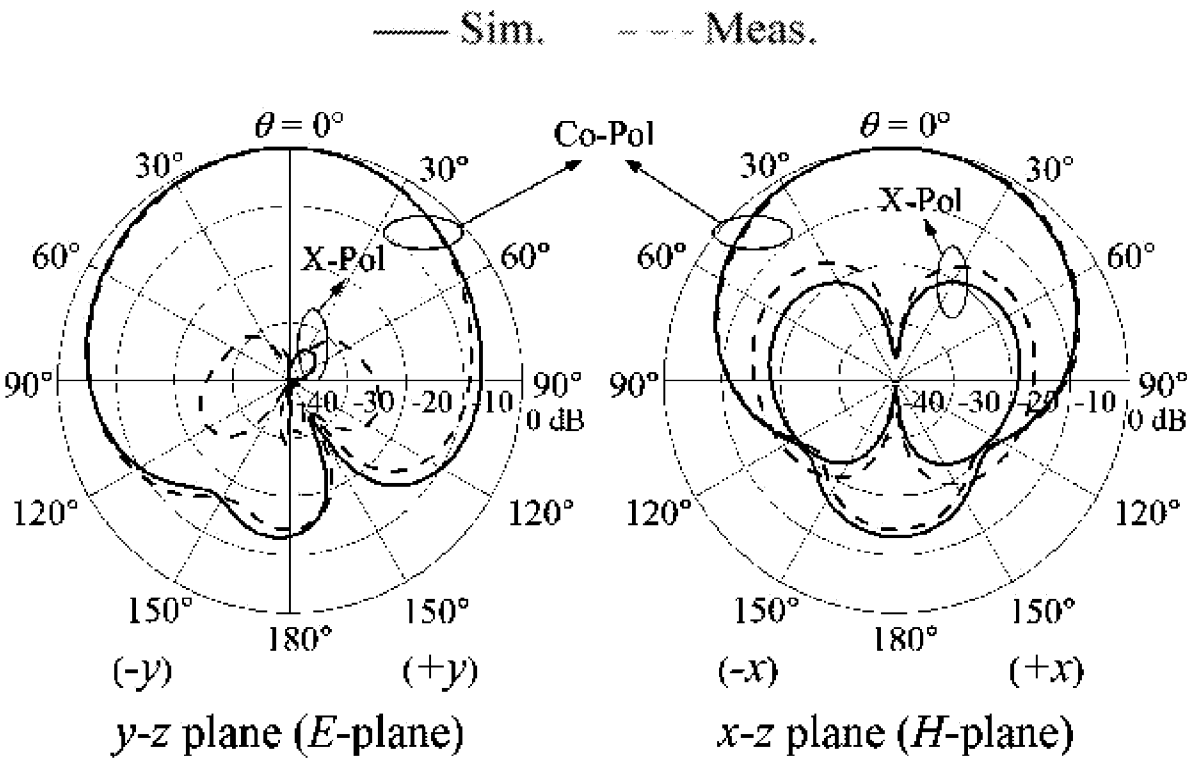
FIG. 20A shows simulated and measured radiation patterns of the antenna of FIG. 18A (operating as an S-band dielectric resonator antenna) in the y-z plane (E-plane) and the x-z plane (H-plane) respectively at 3.0 GHz.
Figure 20B:
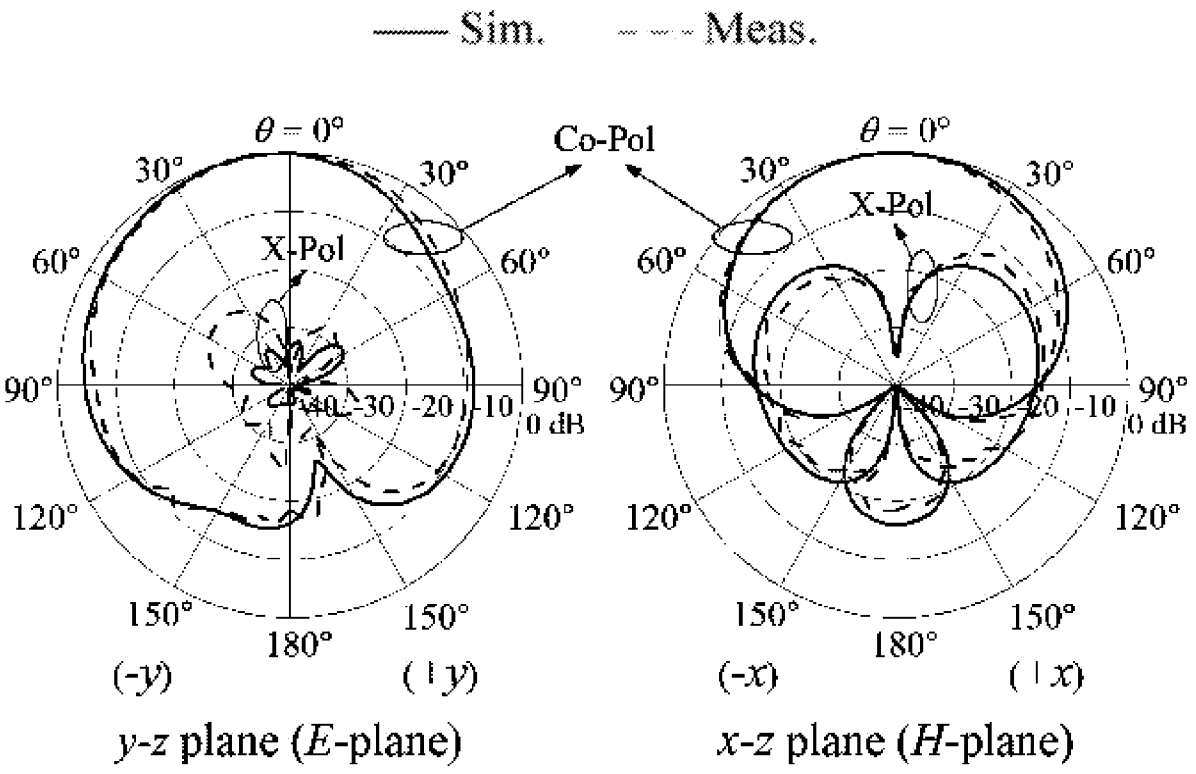
FIG. 20B shows simulated and measured radiation patterns of the antenna of FIG. 18A (operating as an S-band dielectric resonator antenna) in the y-z plane (E-plane) and the x-z plane (H-plane) respectively at 3.5 GHz.
Figure 20C:
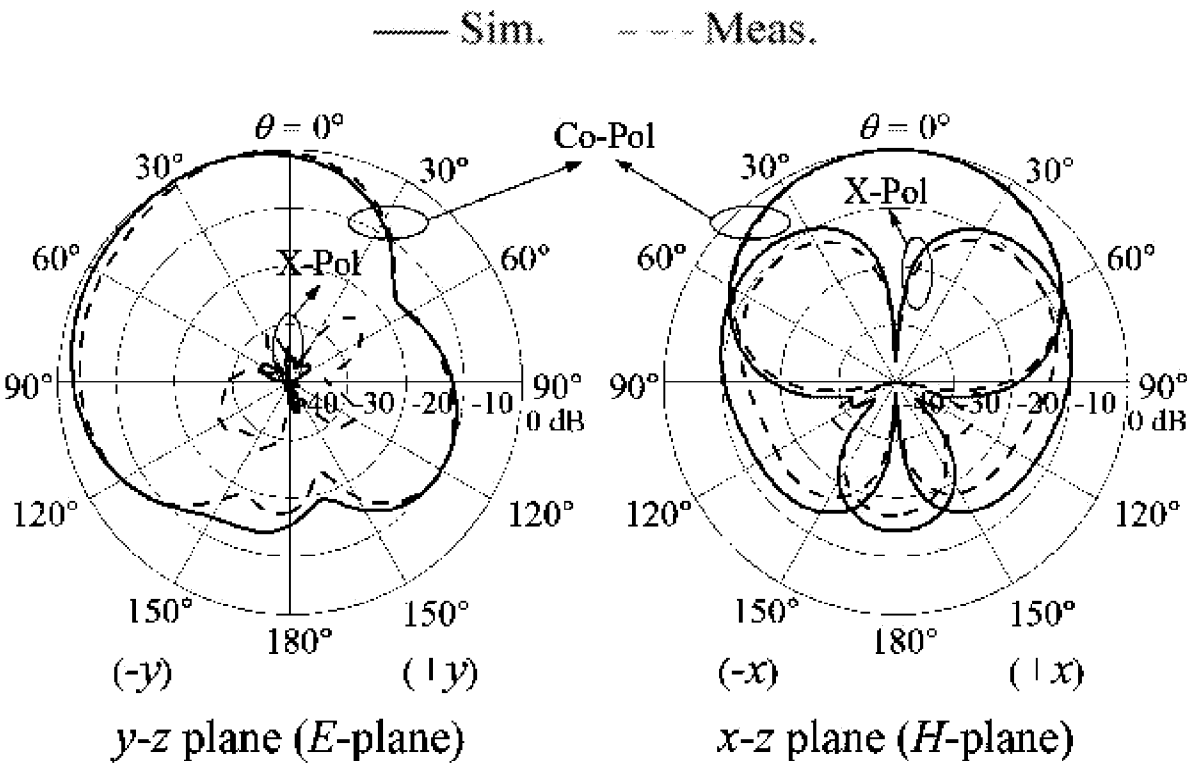
FIG. 20C shows simulated and measured radiation patterns of the antenna of FIG. 18A (operating as an S-band dielectric resonator antenna) in the y-z plane (E-plane) and the x-z plane (H-plane) respectively at 4.0 GHz.

FIGS. 20A to 20C show simulated and measured radiation patterns of the antenna 1800 operating as an S-band dielectric resonator antenna, in the y-z plane (E-plane) and the x-z plane (H-plane) respectively, at 3.0 GHz, 3.5 GHz, and 4.0 GHz. Referring to FIG. 20B, broadside radiation patterns can be observed for both the E- and H-planes. This indicates that the dielectric resonator antenna of antenna 1800 is excited in its $HEM_{11}$ mode. It can also be observed that the measured co-polar fields are desirably stronger than the cross-polar counterparts by 30 dB or more in the boresight direction (θ=0°). Referring to FIGS. 20A and 20C, relatively stable broadside radiation patterns can be observed across the impedance passband. Since the feed strip lies in the y-z plane, the radiation patterns in the y-z planes are slightly asymmetric. As the frequency increases, the loading effect of the strip becomes stronger and thus leads to a more asymmetrical radiation pattern, as shown in FIG. 20C.

Figure 21:
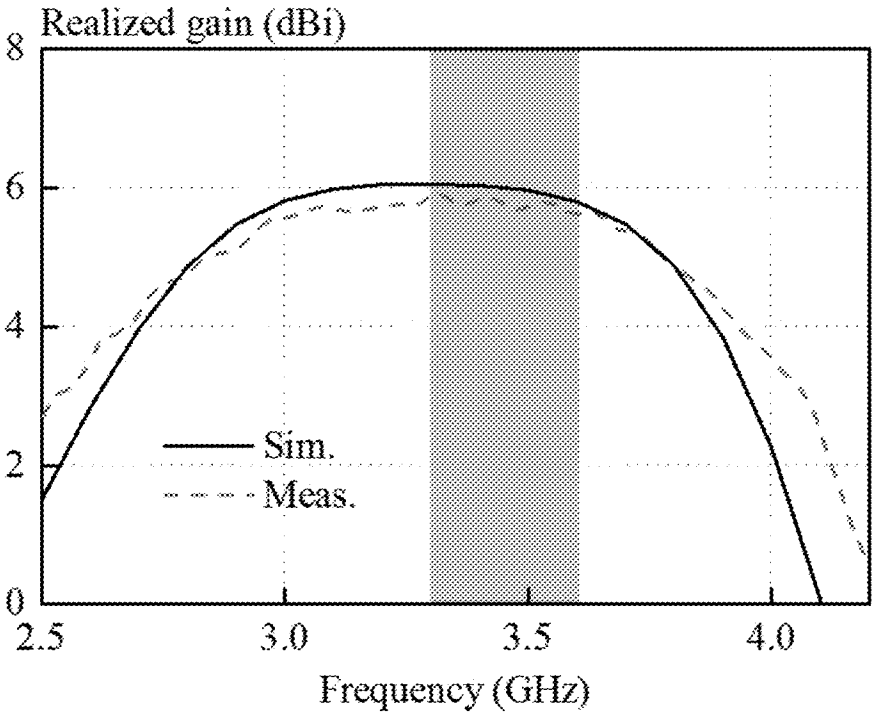
FIG. 21 is a graph showing simulated and measured antenna gains (dBi) of the antenna of FIG. 18A (operating as an S-band dielectric resonator antenna) in the boresight direction (θ=0°) at different frequencies (2.5 GHz to 4.5 GHz)

FIG. 21 shows the measured and simulated realized antenna gains (dBi) (mismatch also considered) of antenna 1800 operating as an S-band dielectric resonator antenna, in the boresight direction (θ=0°) at different frequencies (2.5 GHz to 4.5 GHz). As shown in FIG. 21, the measured and simulated results are in reasonable agreement. As can be expected, the former is generally lower than the latter, due to power loss caused by experimental imperfections. From FIG. 21, it can be seen that both the measured and simulated antenna gains are ~6 dBi at 3.5 GHz. The measured gain is between 5.6 dBi and 5.82 dBi across the sub-6 GHz 5G band (3.3 GHz to 3.6 GHz). It is noted that the antenna gain drops rapidly at the upper-edge frequency band. This is because as the frequency increases, the antenna main beam will deviate from the boresight direction.

Figure 22:
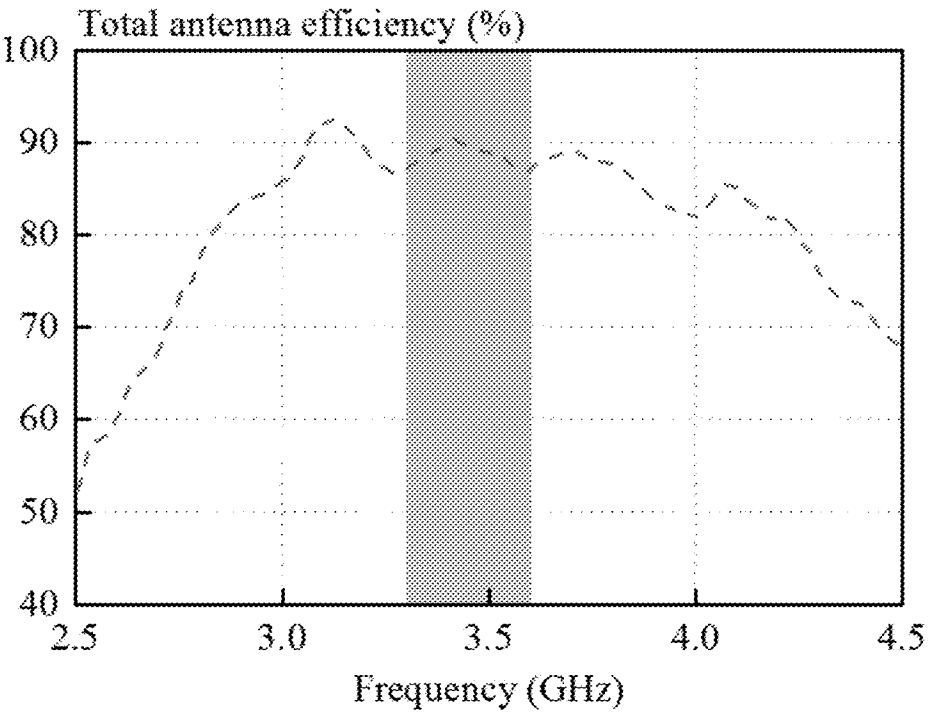
FIG. 22 is a graph showing measured total antenna efficiency (%) of the antenna of FIG. 18A (operating as an S-band dielectric resonator antenna) at different frequencies (2.5 GHz to 4.5 GHz)

FIG. 22 shows the measured total antenna efficiency (%) (mismatch also considered) of antenna 1800 operating as an S-band dielectric resonator antenna at different frequencies (2.5 GHz to 4.5 GHz). As shown in FIG. 22, the S-band dielectric resonator antenna has an average measured antenna efficiency of 88% across the sub-6 GHz 5G band (3.3 GHz to 3.6 GHz), with the peak antenna efficiency given by 90% at 3.45 GHz.

As mentioned, the antenna 1800 is operable as an X-band dielectric lens antenna.

Figure 23:
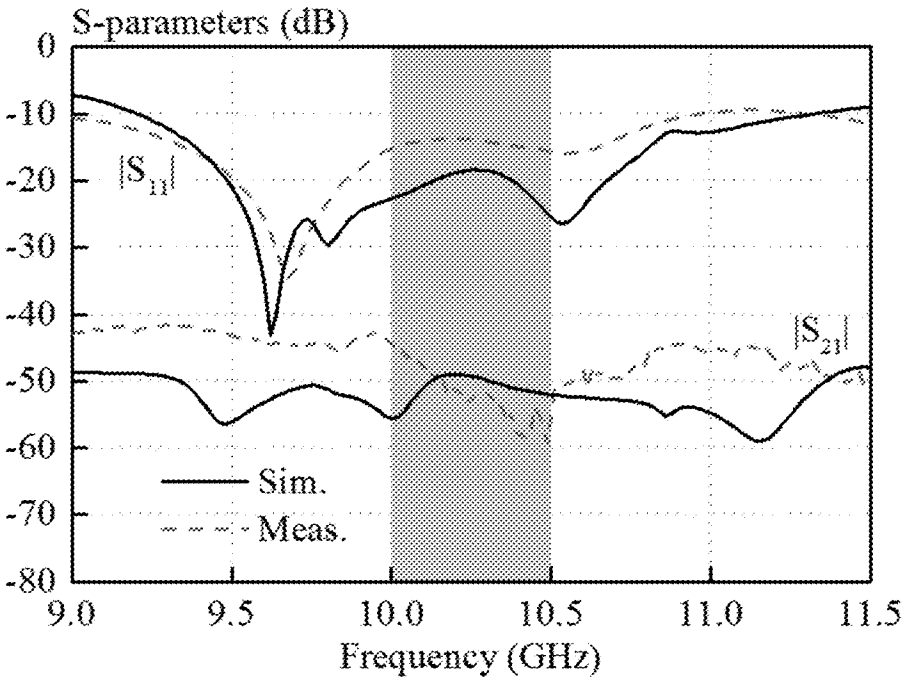
FIG. 23 is a graph showing simulated and measured S-parameters $|S_{11}|$ and $|S_{21}|$ (dB) of the antenna of FIG. 18A (operating as an X-band dielectric lens antenna) at different frequencies (9.0 GHz to 11.5 GHz)

FIG. 23 shows the measured and simulated S-parameters (reflection coefficients and port isolations) of the antenna 1800 operating as an X-band dielectric lens antenna at different frequencies (9.0 GHz to 11.5 GHz). The values of the parameters are the same as those in the antenna 200 of FIG. 2. From FIG. 23, reasonable agreement between the measured and simulated results is observed, with the discrepancy caused by tolerances in the fabrication tolerances in 3D printing and experimental error. The measured 10-dB impedance bandwidth is 19.5% (9.06-11.02 GHz), which generally agrees with the simulated result of 20.6% (9.21-11.33 GHz). Both results can support the mobile-service band (10 GHz to 10.5 GHz). As shown in FIG. 23, the measured port isolation is over 40 dB, which greatly facilitates the two-port design. Although not specifically illustrated, a study is carried out to investigate the effect of the imperfect assembly on the high-band antenna impedance matching, and it is found that the antenna matching level will be worse when there is an offset between the dielectric resonator and coupling slot. However, within a small offset distance of ±2 mm, good impedance matching can be obtained for the high-band dielectric lens antenna.

Figure 24A:
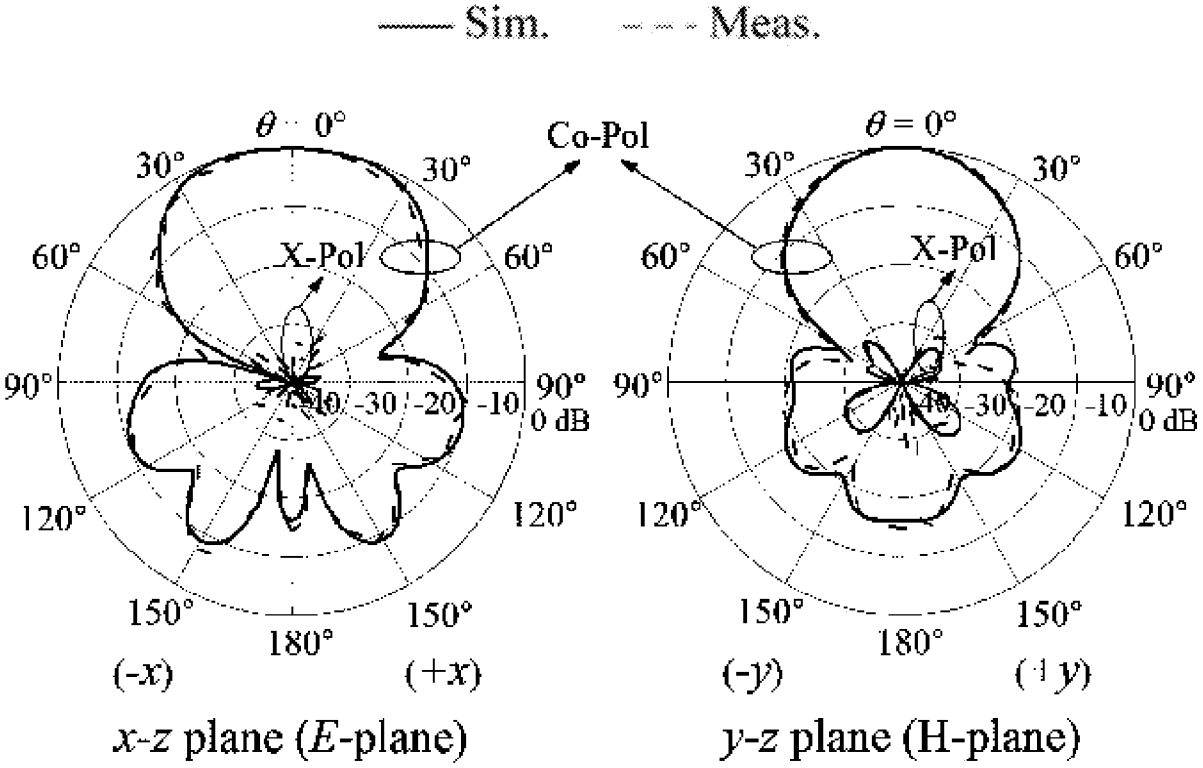
FIG. 24A shows simulated and measured radiation patterns of the antenna of FIG. 18A (operating as an X-band dielectric lens antenna) in the y-z plane (E-plane) and the x-z plane (H-plane) respectively at 9.8 GHz.
Figure 24B:
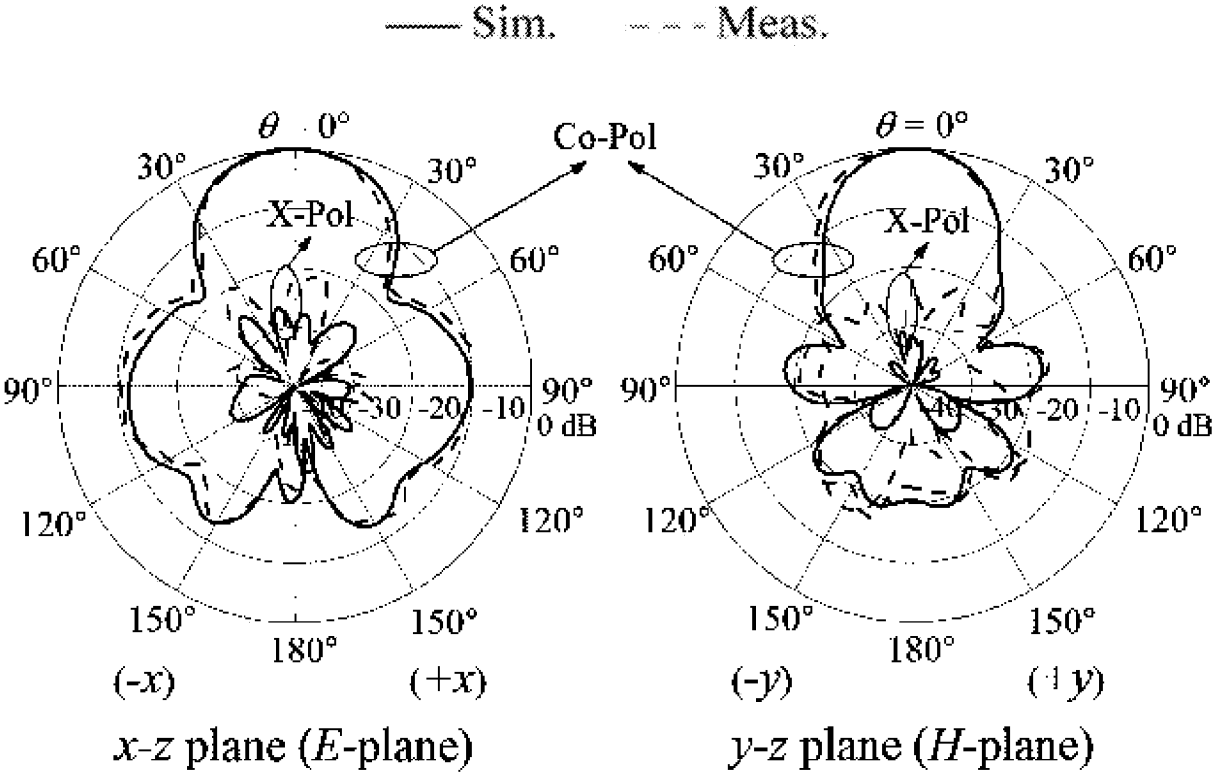
FIG. 24B shows simulated and measured radiation patterns of the antenna of FIG. 18A (operating as an X-band dielectric lens antenna) in the y-z plane (E-plane) and the x-z plane (H-plane) respectively at 10.2 GHz.
Figure 24C:
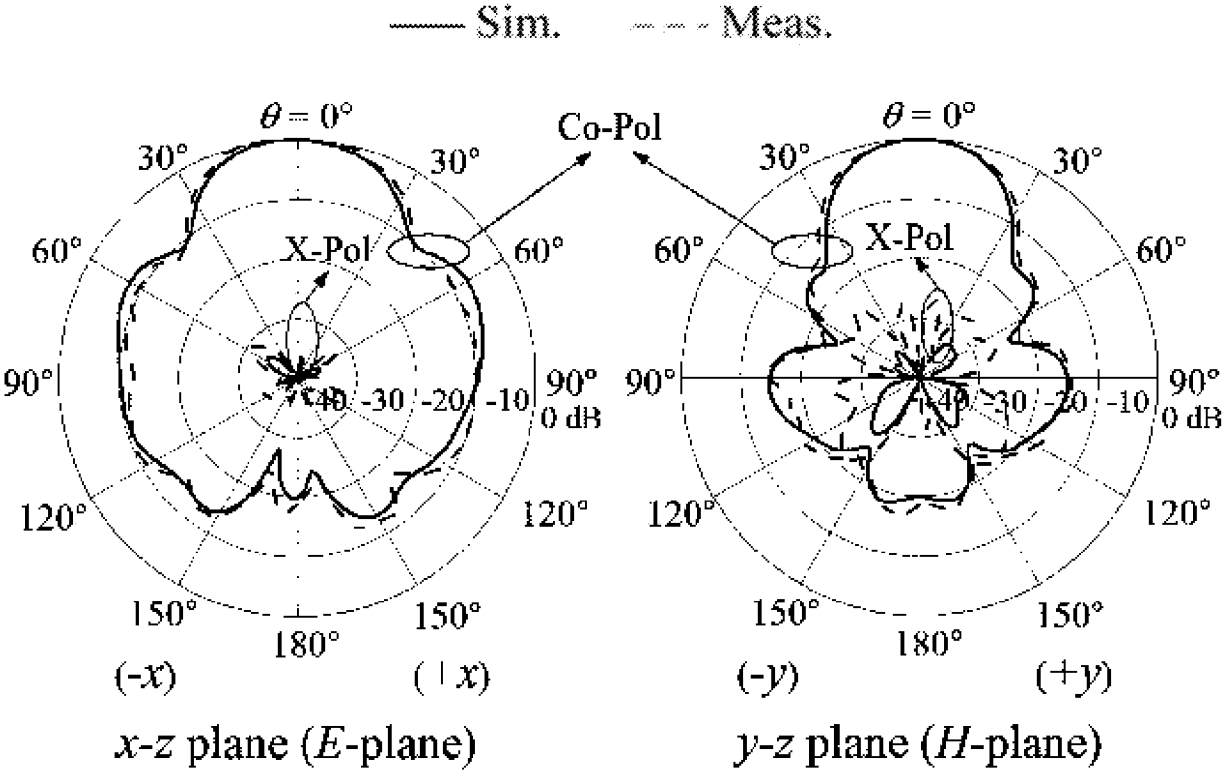
FIG. 24C shows simulated and measured radiation patterns of the antenna of FIG. 18A (operating as an X-band dielectric lens antenna) in the y-z plane (E-plane) and the x-z plane (H-plane) respectively at 10.6 GHz.

FIGS. 20A to 20C show simulated and measured radiation patterns of the antenna 1800 operating as an X-band dielectric lens antenna, in the y-z plane (E-plane) and the x-z plane (H-plane) respectively, at 9.8 GHz, 10.2 GHz, and 10.6 GHz. Referring to FIG. 24B, the dielectric lens antenna has broadside radiation patterns for both E- and H-planes as expected. In each plane, the measured co-polar field is stronger than the cross-polar counterpart by more than 22 dB in the boresight direction (θ=0°). Since the level of the cross-polar fields is relatively low, it is susceptible to be affected by undesirable reflected waves from the cable and imperfect absorbers of the measurement system. These factors are not considered in the simulation, and this leads to the discrepancies between the measurement and simulation results. It is noted that the relatively high measured cross-polar fields in the y-z plane are caused by the low-band metallic feed strip that lies in the y-z plane. Referring to FIGS. 24A and 24C, fairly symmetrical radiation patterns can be observed in both the E- and H-planes. Also, relatively high radiation at +/−90° can be observed. This is caused by the electromagnetic waves that come out from the sidewall of the low-band cylindrical dielectric resonator since these waves cannot be collimated in the boresight direction but instead propagate laterally.

Figure 25:
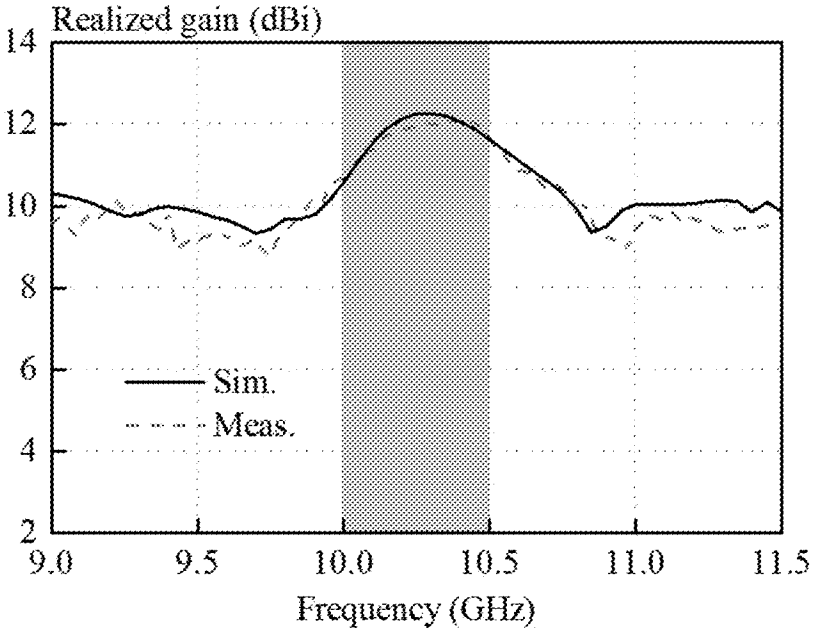
FIG. 25 is a graph showing simulated and measured antenna gains (dBi) of the antenna of FIG. 18A (operating as an X-band dielectric lens antenna) in the boresight direction ($\theta=0°$) at different frequencies (9.0 GHz to 11.5 GHz)

FIG. 25 shows simulated and measured antenna gains (dBi) of the antenna 1800 operating as an X-band dielectric lens antenna in the boresight direction (θ=0°) at different frequencies (9.0 GHz to 11.5 GHz). As shown in FIG. 25, the measured result reasonably agrees with the simulated result. The measured antenna gain ranges from 10.8 dBi to 12.0 dBi across the mobile-service band (10 GHz to 10.5 GHz). Its peak gain is given by 12.0 dBi at 10.3 GHz.

Figure 26:
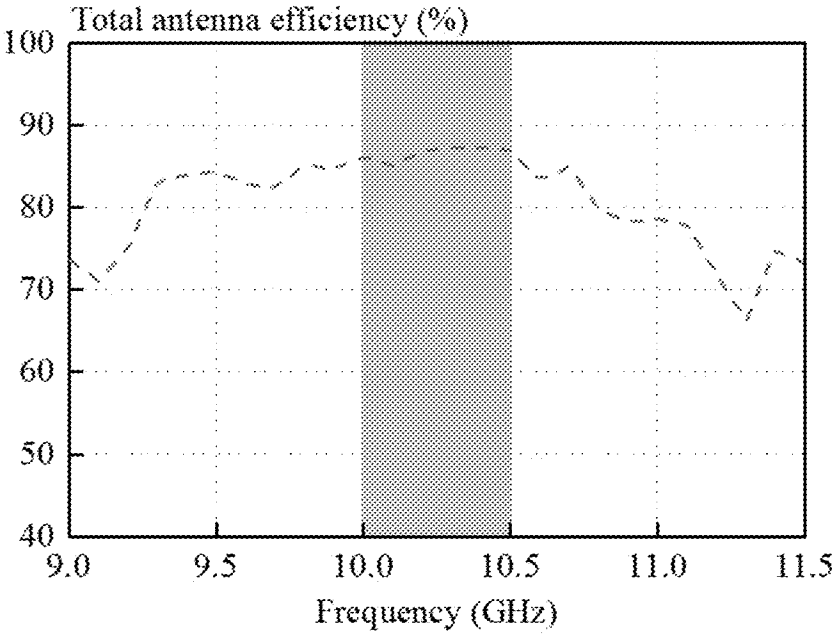
FIG. 26 is a graph showing measured total antenna efficiency (%) of the antenna of FIG. 18A (operating as an X-band dielectric lens antenna) at different frequencies (9.0 GHz to 11.5 GHz)

FIG. 26 is a graph showing measured total antenna efficiency (%) (mismatch also considered) of the antenna 1800 operating as an X-band dielectric lens antenna at different frequencies (9.0 GHz to 11.5 GHz). As shown in FIG. 26, the X-band dielectric lens antenna has the maximum antenna efficiency of 88% at 10.4 GHz. The average measured antenna efficiency over the mobile-service band (10 GHz to 10.5 GHz) is 86%.

The aperture efficiency of the X-band dielectric lens antenna is given by $$e_{ap} = \frac{G\lambda_0^2}{4\pi A} \tag{4}$$

where $e_{ap}$, $\lambda_0$, G, and A are the aperture efficiency, wavelength in air at the center frequency (10.25 GHz), realized antenna gain, and physical aperture size of the antenna, respectively. From the measured result, the aperture efficiency of the dielectric lens antenna is calculated as 94%.

Table 3 shows the characteristics of the dual-band antenna 1800 in this embodiment. Compared with some existing dual-band antennas, the dual-band antenna 1800 in this embodiment has a relatively wide bandwidth and a higher radiation efficiency in the low-band, with better or comparable performance in the high-band. Also, the antenna 1800 has a relatively compact footprint. The antenna 1800 is made mainly of low-loss dielectric material (except for the feed arrangement), and thus can achieve relatively high radiation efficiencies in high-frequency-bands. Furthermore, the antenna 1800, in particular the dielectric parts, can be conveniently fabricated in one go using additive manufacturing (e.g., 3D printing) techniques.

TABLE 3

Characteristics of the dual-frequency-band antenna 1800

| | Center frequency (GHz) | Measured 10-dB bandwidth (%) | Peak gain (dBi) | Minimum antenna efficiency (%) | Antenna type | Antenna size ($\lambda_o^3$) |
|---|---|---|---|---|---|---|
| Low-band | 3.5 | 40.2 | 5.82 | 86 | Dielectric resonator antenna | $\pi \times 0.16^2 \times 0.33$ |
| High-band | 10.25 | 19.5 | 12.0 | 85 | Dielectric lens antenna | |

$\lambda_o$: Wavelength in air at the center frequency of lower band

Although not illustrated, a study is performed to evaluate the effect of the ground plane size on the antenna performance. In the study, a much larger ground plane of $10L_g \times 10W_g$ (700×600 mm$^2$) is compared with the ground plane of $L_g \times W_g$ (70×60 mm$^2$) in the antenna 200. It is found that the antenna reflection coefficients are basically unaffected by the ground plane size. Good impedance matching can be obtained in the two bands when using a larger ground plane. As for the antenna radiation patterns, in the low band at 3.5 GHz, the larger ground plane can widen the low-band antenna 3 dB beamwidth in the H-plane and introduce many ripples in the E-plane, thus reducing the boresight antenna gain. For the high band at 10.2 GHz, for the larger ground plane, the high-band antenna will have higher side lobes but lower back lobes in the E- and H-planes. In these two principal planes, its 3 dB beamwidths remain substantially unchanged, with the peak antenna gain nearly the same as that of the original design. Based on these finding, the antenna 1800 could be a good candidate for use in vehicular communications.

The above disclosure has presented various antenna embodiments of the invention. In some embodiments, the antenna is a 3D-printed wideband two-port dual-frequency dielectric antenna suitable for use in vehicular communications. In some embodiments, the antenna has integrated an S-band dielectric resonator antenna with an X-band dielectric lens antenna, with the former excited in its fundamental $HEM_{11\delta}$ mode by a conductive strip, and the latter fed by an embedded cylindrical dielectric resonator antenna/element. In one embodiment, a dual-frequency-band antenna operating at S- and X-bands is designed, fabricated, and tested. In that embodiment, the antenna has a measured 10-dB impedance bandwidths of 40.2% and 19.5% for S- and X-bands, respectively. In that embodiment, the antenna has good antenna efficiencies, with average S- and X-band values given by 88% and 86%, respectively. The measured isolations between the two ports can be over 40 dB.

In some embodiments, the antenna has a relatively compact structure, a relatively wide impedance bandwidth, and/or relatively high radiation efficiencies. In some embodiments, the antenna can be fabricated relatively easily, e.g., using additive manufacturing technologies. In some embodiments, the antenna is particularly useful for modern vehicular communication systems. In some embodiments, the antenna is operable as the low-band dielectric resonator antenna and high-band dielectric lens antenna, utilizing the same dielectric body, and thus the antenna structure is compact. The high-band dielectric lens antenna can be fed by an embedded cylindrical dielectric resonator antenna/element, which can reduce conduction loss in the high band while maintaining a relatively compact antenna size. In some embodiments, the antenna can provide wide impedance bandwidths in the two bands and features high degree of flexibility without the limitation of the frequency ratio. This is because the low and high bands of our design are based on different operating principles. In some embodiments, the antenna is designed for S-band 5G vehicular-to-base station and X-band vehicular-to-satellite communications, respectively. In some embodiments, the antenna is fabricated using the FDM 3D printing method.

Figure 27:
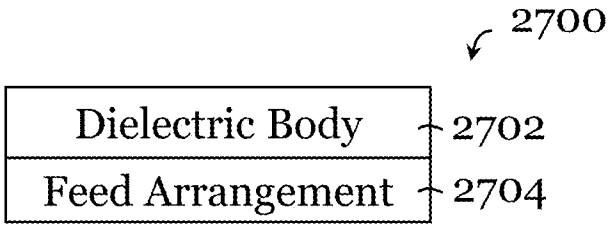
FIG. 27 is a functional block diagram of an antenna in one embodiment of the invention.

FIG. 27 illustrates a high level design concept of an antenna 2700 in one embodiment of the invention. The antenna 2700 includes a (single) dielectric body 2702 having, at least, a first portion operable as a dielectric lens and a second portion operable as a dielectric resonator, as well as a feed arrangement 2704 operably coupled with the dielectric body 2702, for operating the antenna 2700 as a dielectric lens antenna and a dielectric resonator antenna, selectively or simultaneously. The antenna 2700 can act as one of: a receiver antenna, a transmitter antenna, and a transceiver antenna. The first portion of the body 2702 may also operate as a dielectric resonator, e.g., when the antenna operates as the dielectric resonator antenna.

The antenna 2700 may operate as the dielectric lens antenna at a first frequency (or frequency band) and as the dielectric resonator antenna at a second frequency (or frequency band) different from the first frequency (or frequency band). The first frequency (or frequency band) can be higher than the second frequency (or frequency band). The first frequency band can be spaced apart from the second frequency band. The first frequency band (X-band) can be higher than the second frequency band (S-band).

Depending on construction the first and second portions may have different dielectric constants or different effective dielectric constants. The dielectric constants or effective dielectric constants can take different values in different designs, depending on applications. The dielectric constants or effective dielectric constants of the first portion may be smaller than that of the second portion. The first and second portions may have different shape, size, mass, boundary surface, contour, construction, etc. The first and second portions may be made from the same or different materials. The first portion, or the dielectric lens portion, can have convex of concave boundary surface(s). The first and second portions can be solid, can have ribbed or waffle structure (as illustrated in the above embodiments), etc. The dielectric body 2702, or the first and/or second portions, can be but need not be additively manufactured.

The feed arrangement can include at least two separate feed mechanism, one for operating the antenna 2700 as the dielectric lens antenna and one for operating the antenna 2700 as the dielectric lens antenna. Each of the feed mechanism can be based on probe feed, slot feed, strip feed, etc., as appropriate and applicable. Some specific feed mechanisms are illustrated in the above embodiments. The feed mechanism(s) may be connected with RF connector(s). Some feed mechanisms may facilitate beam steering for the dielectric lens antenna. Some feed mechanisms may not facilitate beam steering for the dielectric lens antenna. The antenna 2700 can include a substrate with a ground plane, on which part of the feed arrangement is arranged. The substrate can be PCB substrate, one-sided or two-sided, single-layer or multi-layers.

The antenna 2700 can be applied (e.g., attached or mounted) to a vehicle for use in vehicular communications, e.g., for communicating data and/or information with base station(s), satellite(s), intelligent infrastructure(s), intelligent transportation system(s), other vehicle(s), etc. The data and/or information may be related to vehicle location, position, status, operation, etc., or multimedia, etc. Additionally or alternatively, the antenna 2700 may be used in communication device, such as mobile or portable devices, and/or communication systems, such as vehicular communication systems, satellite communication systems, etc. Additionally or alternatively, the antenna 2700 may be arranged in an array to form an antenna array.

Figure 28:
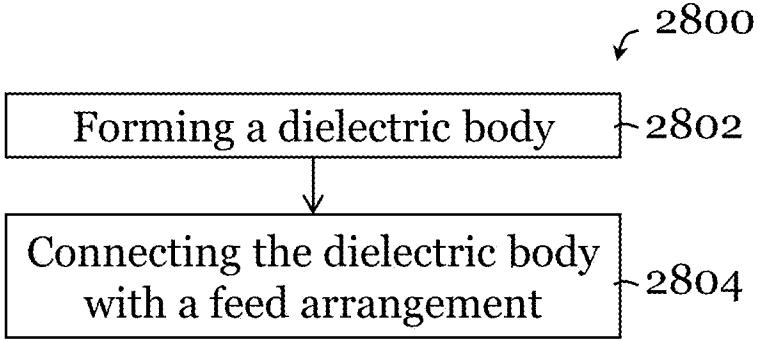
FIG. 28 is a flow chart illustrating a method for making the antenna of FIG. 27.

FIG. 28 shows a method 2800 for making the antenna 2700. The method 2800 includes, in step 2802, forming a dielectric body having a first portion operable as a dielectric lens and a second portion operable as a dielectric resonator, and in step 2804, connecting the dielectric body with a feed arrangement such that the feed arrangement is operably coupled with the dielectric body for operating the antenna as a dielectric lens antenna and a dielectric resonator antenna. In step 2802 the forming may include integrally forming the dielectric body. The forming can be performed by molding, additive manufacturing, e.g., 3D printing, etc. In step 2084, the connecting may include affixing the dielectric body with the feed arrangement using adhesives or fasteners.

It will be appreciated by persons skilled in the art that numerous variations and/or modifications may be made to the embodiments of the invention as specifically disclosed. The described embodiments of the invention should therefore be considered in all respects as illustrative, not restrictive. Non-exhaustive optional features of the invention are set forth in the summary. Some embodiments of the may include one or more of the optional features. Some of the embodiments may be without one or more of the optional features. Regardless of how the antenna is implemented in practice, an important aspect of the invention is based on the idea that at least a dielectric resonator antenna and a dielectric lens antenna can be integrated together, e.g., by virtue of suitably designed dielectric arrangements (unitary dielectric body) and feed arrangements. For example, the dielectric lens portion can include a convex boundary surface. For example, the dielectric lens portion can include a concave boundary surface. The antenna may be a multi-band antenna that is operable at multiple (two or more) frequency bands. The frequency bands can be different from those illustrated.

The invention claimed is:

1. An antenna, comprising:

a dielectric body comprising a first portion operable as a dielectric lens and a second portion operable as a dielectric resonator; and a feed arrangement operably coupled with the dielectric body, for operating the antenna as a dielectric lens antenna and a dielectric resonator antenna;

wherein the feed arrangement comprises:

a first feed mechanism operably coupled with the dielectric body, for operating the antenna as the dielectric lens antenna; and a second feed mechanism operably coupled with the dielectric body, for operating the antenna as the dielectric resonator antenna.

2. The antenna of claim 1, wherein the antenna is operable as the dielectric lens antenna and the dielectric resonator antenna simultaneously.

3. The antenna of claim 1, wherein the first portion is further operable as a dielectric resonator.

4. The antenna of claim 1, wherein:

the antenna is arranged to operate as the dielectric lens antenna at a first frequency band; and the antenna is arranged to operate as the dielectric resonator antenna at a second frequency band different from the first frequency band.

5. The antenna of claim 4, wherein the first frequency band is spaced apart from the second frequency band.

6. The antenna of claim 5, wherein the first frequency band is higher than the second frequency band.

7. The antenna of claim 6, wherein the first frequency band comprises X-band and/or the second frequency band comprises S-band.

8. The antenna of claim 1, wherein:

the first portion has a first dielectric constant; and the second portion has a second dielectric constant larger than the first dielectric constant.

9. The antenna of claim 1, wherein:

the first portion has a first effective dielectric constant; and the second portion has a second effective dielectric constant larger than the first effective dielectric constant.

10. The antenna of claim 1, wherein the first portion defines, at least, a generally dome shaped boundary surface.

11. The antenna of claim 10, wherein the first portion comprises a waffle structure.

12. The antenna of claim 11, wherein the waffle structure comprises a first array of ribs and a second array of ribs intersecting with the first array of ribs in a decussate manner.

13. The antenna of claim 1, wherein the second portion defines, at least, a generally cylindrical boundary surface.

14. The antenna of claim 13, wherein the second portion comprises a waffle structure.

15. The antenna of claim 14, wherein the waffle structure comprises a first array of ribs and a second array of ribs intersecting with the first array of ribs in a decussate manner.

16. The antenna of claim 9, wherein the first portion has a first air-filling ratio and the second portion has a second air-filling ratio less than the first air-filling ratio.

17. The antenna of claim 1, wherein the first portion is arranged directly above the second portion, relative to the feed arrangement.

18. The antenna of claim 1, wherein the first feed mechanism comprises one or more feed antennas.

19. The antenna of claim 18, wherein each of the one or more feed antennas comprises a slot-coupled dielectric resonator antenna.

20. The antenna of claim 19, wherein the slot-coupled dielectric resonator antenna comprises:

a dielectric resonator element;

a coupling slot arranged in a ground plane on one side of a substrate; and a feedline arranged on another side of the substrate and operably coupled with the coupling slot.

21. The antenna of claim 20, wherein the dielectric resonator element is received by or substantially enclosed by the dielectric body.

22. The antenna of claim 1, wherein the second feed mechanism comprises:

a feed strip attached to the dielectric body or the second portion;

a feedline arranged on one side of a substrate; and a conductor arranged to electrically connect the feed strip and the feedline.

23. The antenna of claim 1, wherein the dielectric body is additively manufactured.

24. The antenna of claim 1, wherein the antenna is a multi-band antenna.

25. An antenna, comprising:

a dielectric body comprising a first portion operable as a dielectric lens and a second portion operable as a dielectric resonator; and a feed arrangement operably coupled with the dielectric body, for operating the antenna as a dielectric lens antenna and a dielectric resonator antenna;

wherein the first portion comprises a waffle structure and defines, at least, a generally dome shaped boundary surface.

26. The antenna of claim 25, wherein the waffle structure comprises a first array of ribs and a second array of ribs intersecting with the first array of ribs in a decussate manner.

27. An antenna, comprising:

a dielectric body comprising a first portion operable as a dielectric lens and a second portion operable as a dielectric resonator; and a feed arrangement operably coupled with the dielectric body, for operating the antenna as a dielectric lens antenna and a dielectric resonator antenna;

wherein the second portion comprises a waffle structure and defines, at least, a generally cylindrical boundary surface.

28. The antenna of claim 27, wherein the waffle structure comprises a first array of ribs and a second array of ribs intersecting with the first array of ribs in a decussate manner.

29. An antenna, comprising:

a dielectric body comprising a first portion operable as a dielectric lens and a second portion operable as a dielectric resonator; and a feed arrangement operably coupled with the dielectric body, for operating the antenna as a dielectric lens antenna and a dielectric resonator antenna;

wherein the first portion has a first effective dielectric constant and a first air-filling ratio; and wherein the second portion has a second effective dielectric constant larger than the first effective dielectric constant and a second air-filling ratio less than the first air-filling ratio.

30. The antenna of claim 29, wherein the first portion defines, at least, a generally dome shaped boundary surface.

31. The antenna of claim 29, wherein the first portion comprises a waffle structure.

32. The antenna of claim 31, wherein the waffle structure comprises a first array of ribs and a second array of ribs intersecting with the first array of ribs in a decussate manner.

33. The antenna of claim 29, wherein the second portion defines, at least, a generally cylindrical boundary surface.

34. The antenna of claim 29, wherein the second portion comprises a waffle structure.

35. The antenna of claim 34, wherein the waffle structure comprises a first array of ribs and a second array of ribs intersecting with the first array of ribs in a decussate manner.

* * * * *